US008038337B2

(12) United States Patent
Rathgeber et al.

(10) Patent No.: US 8,038,337 B2
(45) Date of Patent: Oct. 18, 2011

(54) METHOD AND DEVICE FOR BLENDING SMALL QUANTITIES OF LIQUID IN MICROCAVITIES

(75) Inventors: Andreas Rathgeber, München (DE); Matthias Wassermeier, München (DE)

(73) Assignee: Beckman Coulter, Inc., Brea, CA (US)

( * ) Notice: Subject to any disclaimer, the term of this patent is extended or adjusted under 35 U.S.C. 154(b) by 1405 days.

(21) Appl. No.: 10/547,267

(22) PCT Filed: Feb. 23, 2004

(86) PCT No.: PCT/EP2004/001774

§ 371 (c)(1),
(2), (4) Date: Aug. 29, 2005

(87) PCT Pub. No.: WO2004/076046

PCT Pub. Date: Sep. 10, 2004

(65) Prior Publication Data

US 2006/0275883 A1 Dec. 7, 2006

(30) Foreign Application Priority Data

Feb. 27, 2003 (DE) ..... 103 08 622
Jun. 4, 2003 (DE) ..... 103 25 307

(51) Int. Cl.
*B01F 11/02* (2006.01)

(52) U.S. Cl. ..... 366/115; 366/114; 366/116; 366/127

(58) Field of Classification Search ..... 366/127, 366/114–116; 435/173.1, 135.1
See application file for complete search history.

(56) References Cited

U.S. PATENT DOCUMENTS

| | | | | | |
|---|---|---|---|---|---|
| 2,420,864 | A | * | 5/1947 | Chilowsky | 29/25.35 |
| 3,343,105 | A | * | 9/1967 | Van der Pauw | 333/147 |
| 3,433,461 | A | * | 3/1969 | Scarpa | 366/112 |
| 3,575,383 | A | * | 4/1971 | Coleman | 366/115 |
| 3,678,304 | A | * | 7/1972 | Humphryes et al. | 310/313 B |
| 3,727,718 | A | * | 4/1973 | Whitehouse | 73/596 |
| 4,011,747 | A | * | 3/1977 | Shaw | 73/618 |
| 4,173,009 | A | * | 10/1979 | Toda | 367/164 |

(Continued)

FOREIGN PATENT DOCUMENTS

DE 19833197 2/1999

(Continued)

OTHER PUBLICATIONS

J R Asay, A H Guenther. Experimental determination of ultrasonic wave velocities in plastics as functions of temperature. IV. Shear velocities in common plastics. Journal of Applied Polymer Science v 11 (1967) pp. 1087-1100.*

(Continued)

*Primary Examiner* — David Sorkin
*Assistant Examiner* — Andrew Janca
(74) *Attorney, Agent, or Firm* — Kilpatrick Townsend & Stockton LLP

(57) ABSTRACT

A method for treating extremely small particles of recycled polyethylene terephthalate comprises providing a quantity of RPET particles having an average mean particle size ranging from about 0.0005 inch to about 0.05 inch in diameter, heating the RPET particles to a temperature sufficient to cause at least a portion of the RPET particles to adhere to one another, and forming the adhered RPET particles into pellets, said pellets having substantially the same average surface-to-volume ratio as the bulk, un-adhered RPET particles.

45 Claims, 18 Drawing Sheets

U.S. PATENT DOCUMENTS

| | | | | |
|---|---|---|---|---|
| 4,349,794 | A * | 9/1982 | Kagiwada et al. | 333/141 |
| 4,697,195 | A * | 9/1987 | Quate et al. | 347/46 |
| 4,746,882 | A * | 5/1988 | Solie | 333/196 |
| 4,908,542 | A * | 3/1990 | Solie | 310/313 B |
| 4,978,503 | A * | 12/1990 | Shanks et al. | 422/58 |
| 5,006,749 | A * | 4/1991 | White | 310/323.03 |
| 5,192,502 | A * | 3/1993 | Attridge et al. | 422/57 |
| 5,512,492 | A * | 4/1996 | Herron et al. | 436/518 |
| 5,646,039 | A * | 7/1997 | Northrup et al. | 435/287.2 |
| 5,674,742 | A | 10/1997 | Northrup et al. | |
| 5,717,434 | A * | 2/1998 | Toda | 345/177 |
| 5,736,100 | A | 4/1998 | Miyake et al. | |
| 5,902,489 | A * | 5/1999 | Yasuda et al. | 210/748 |
| 6,010,316 | A * | 1/2000 | Haller et al. | 417/322 |
| 6,168,948 | B1 | 1/2001 | Anderson et al. | |
| 6,244,738 | B1 | 6/2001 | Yasuda et al. | |
| 6,316,274 | B1 * | 11/2001 | Herron et al. | 436/518 |
| 6,357,907 | B1 | 3/2002 | Cleveland et al. | |
| 6,431,184 | B1 | 8/2002 | Taniyama | |
| 6,568,052 | B1 | 5/2003 | Rife et al. | |
| 7,686,500 | B2 * | 3/2010 | Laugharn et al. | 366/127 |
| 7,687,026 | B2 * | 3/2010 | Laugharn et al. | 422/3 |
| 7,687,039 | B2 * | 3/2010 | Laugharn et al. | 422/128 |
| 7,942,568 | B1 * | 5/2011 | Branch et al. | 366/127 |
| 2001/0055529 | A1 * | 12/2001 | Wixforth | 417/53 |
| 2002/0009015 | A1 | 1/2002 | Laugharn et al. | |
| 2004/0072366 | A1 * | 4/2004 | Wixforth et al. | 436/180 |
| 2004/0105476 | A1 * | 6/2004 | Wasserbauer | 372/50 |
| 2004/0115097 | A1 * | 6/2004 | Wixforth et al. | 422/100 |
| 2004/0257906 | A1 * | 12/2004 | Scriba et al. | 366/127 |
| 2005/0003737 | A1 * | 1/2005 | Montierth et al. | 451/5 |
| 2006/0096353 | A1 * | 5/2006 | Hawkes et al. | 73/24.03 |
| 2006/0230833 | A1 * | 10/2006 | Liu et al. | 73/649 |
| 2007/0264161 | A1 * | 11/2007 | Rathgeber | 422/100 |
| 2008/0095667 | A1 * | 4/2008 | Murakami et al. | 422/68.1 |
| 2008/0316477 | A1 * | 12/2008 | Murakami | 356/244 |

FOREIGN PATENT DOCUMENTS

| | | | |
|---|---|---|---|
| DE | 10117772 | | 10/2002 |
| DE | 10142788 | | 3/2003 |
| DE | 10325313 | | 7/2004 |
| EP | 516565 | | 12/1992 |
| EP | 1596974 | B1 * | 6/2007 |
| WO | WO 94/05414 | * | 3/1994 |
| WO | 97/25531 | | 7/1997 |
| WO | 00/10011 | | 2/2000 |
| WO | WO 00/25125 | * | 5/2000 |
| WO | 01/20781 | | 3/2001 |
| WO | 02/28523 | | 4/2002 |
| WO | WO 02/081070 | A1 * | 10/2002 |
| WO | 03/018181 | | 3/2003 |

OTHER PUBLICATIONS

"Alternating current", Wikipedia Jun. 20, 2008.*

F L Teixeira, K Radhakrishnan, W C Chew. High-frequency transmission lines. In Wiley Encyclopedia of Electrical and Electronics Engineering, 1999 John Wiley and Sons, Inc.*

Selfridge, Alan R. Approximate material properties in isotropic materials. IEEE Transactions on Sonics and Ultrasonics v SU-32 No. 3 (May 1985) 381-394.*

Strobl, C J, et al. Planar microfluidic processors. 2002 IEEE Ultrasonics Symposium-255.*

Bittner, R, et al. Dynamical investigation of macromolecular hybridization bioassays. National physics archive (arXiv) physics/0207064 (Jul. 16, 2002).*

Rathgeber, A, et al. Acoustic 'distributed source' mixing of smallest fluid volumes. National physics archive (arXiv) physics/0306080 v1 (Jun. 10, 2003).*

Zhen Yang et al.: "Ultrasonic Micromixer for Microfluidic Systems," IEEE, Jan. 23, 2000, pp. 80-85.

Vivek et al., "Novel Acoustic-Wave Micromixer," IEEE, Jan. 23, 2000, pp. 668-673.

"Acoustic Streaming," Physical Acoustics 2B; E.D. W.P. Mason; Academic Press (1965), pp. 265-271.

"Liquid Streaming and Droplet Formation . . . ," Shikawa et al., Ultrasonics Symposium 1989, pp. 643-646.

Zhu et al., "Microfluidic Motion Generation with Acoustic Waves," Sensors and Actuators A vol. 66 (1998), pp. 355-360.

* cited by examiner

METHOD AND DEVICE FOR BLENDING SMALL QUANTITIES OF LIQUID IN MICROCAVITIES

BACKGROUND OF THE INVENTION

The present invention relates to a method for thorough mixing of liquids in microcavities and a device for carrying out said method.

Microcavities, for example in an arrangement of microtitre plates, are employed in pharmaceutical research and diagnostics as reaction vessels. On the basis of the standard format of microtitre plates highly automated processing sequences are possible in modern laboratories. For example, pipetting robots, units for optical reading of biological assays and also the corresponding transport systems are thus matched to the standard format. Such standard microtitre plates exist currently with 96, 384 or 1536 cavities. Typical volumes per cavity are in the range of 300 μl for 96 titre plates, approximately 75 μl for 384 microtitre plates and approximately 12 μl for 1536 titre plates. Microtitre plates are generally made from plastic, for example polypropylene or polystyrol, and are frequently coated or biologically functionalised.

Miniaturising in the form of such microtitre plates or respectively microcavities is generally based on often expensive reagents and in the fact that sample material is frequently not available in the desired quantity, so that reactions at high sample concentration can be carried out only if the volumes are accordingly reduced.

So as to accelerate the reactions and also to ensure homogeneous reaction conditions, it is desirable to mix the reactants during the reaction. This is of significance in particular whenever a reaction partner ("sample") is bound, that is, an inhomogeneous assay is present. Here, thorough mixing can prevent depletion of the sample on the bound probes. In the case of insufficiently thorough mixing frequently diffusion of the reactants quite generally is the time-determining step. This results in long reaction times and minimal sample throughput.

Microtitre plates or respectively in general microcavities are mixed thoroughly in known methods by means of so-called agitators. Such agitators comprise mechanically mobile components and are in part difficult to integrate into highly-automated lines. The thorough mixing is also highly inefficient in particular in small cavities, therefore for example 384 microtitre plates or 1536 microtitre plates. With such small microcavities small quantities of liquid are seemingly highly viscous and only laminar currents in small volumes are possible, that is, there is no turbulence which might cause effective thorough mixing. To achieve an adequate mixing effect, despite the viscosity becoming seemingly high in small quantities of liquid, a high output from the agitator is required.

WO 00/10011 thus describes a method, by means whereof a microcavity in the frequency range from 1 to 300 kHz is agitated. Outputs of 0.1 to 10 Watt are applied.

The literature describes other different methods for thoroughly mixing small quantities of liquid.

US 2002/0009015 A1 describes the use of cavitation for mixing, therefore nucleation, expansion and disintegration or collapse of a local vacuum space in the liquid or a bubble, therefore a local gas/steam space in the liquid, based on an acoustic pressure field. Mixing the liquid is achieved by the intrinsic dynamics of the local vacuum space or respectively the bubble, therefore its expansion and disintegration. To lower the acoustic output threshold for forming the local vacuum spaces or respectively bubbles, nucleation nuclei are needed. These nucleation nuclei heighten the danger of contamination. In addition to this, the development of local vacuum spaces or bubbles is often unwanted.

Other known method (for example "Microfluidic motion generation with acoustic waves", X. Zhu et al. Sensors and Actuators, A. Physical, Vol. 66/1-3, page 355 to 360 (1998) or "Novel acoustic wave micromixer", V.Vivek et al., IEEE International Microelectro mechanical systems conference 2002, pages 668 to 673, or U.S. Pat. No. 5,674,742) describe the use of membranous elements, which oscillate in so-called "flexural plate wave modes". The motion-compromising medium is at the same time in direct contact with the liquid. The manufacturing of such thin membranes is highly complicated and the danger of contamination by contact of liquid with the motion-compromising medium is heightened.

U.S. Pat. No. 6,357,907 B1 describes the use of magnetic spheres, moving in an external, temporally or spatially variable magnetic field. To carry out the mixing procedure the spheres must be introduced to the liquid, an action often not desired on account of contamination problems.

U.S. Pat. No. 6,244,738 B1 describes a mixing procedure in a long-stretched-out closed channel. Two liquid currents flow past an ultrasound sender and are intermixed in the microchannel. To carry out the method a complicated structure with a microchannel system is needed and no separate individual volumes can be mixed.

U.S. Pat. No. 5,736,100 describes the use of a rotary table with small vessels, in which microcavities, for example Eppendorf caps, can be set. In these caps there is for example water, which is radiated from the outside with ultrasound. The described device therefore works as a conventional ultrasound bath. The water is set in oscillating motion and acts as a motion-compromising element directly on each cap, which is agitated in this way.

DE-A-101 17 772 describes the thorough mixing of liquids using surface sound waves, generated by means of interdigital transducers. The liquid is directly on the sound-compromising medium itself. At least in the case of multiple use of the devices there is the danger of contamination. Use with a microtitre plate is not possible in the arrangements described.

SUMMARY OF THE INVENTION

The object of the present invention is to provide a method and a device, which enable effective thorough mixing of liquids in microcavities, in particular a microtitre plate, and minimise the danger of contamination.

This task is solved by a method and device having the characteristics The description herein is also directed to advantageous embodiments.

According to the present invention by means of at least one piezoelectric ultrasonic transducer an ultrasound wave of a frequency greater than or equal to 10 MHz is sent through a solid-body layer in the direction of the at least one microcavity and the liquid contained therein, to generate there a sound-induced flow. The dimension of the solid-body layer in the direction of sound propagation is greater than a ¼ of the wavelength of the ultrasound wave.

The frequency range greater than or equal to 10 MHz ensures that agitating the whole device, as is used for example in agitation mechanisms of the prior art, does not occur in the method according to the present invention. A solid-body layer, greater than ¼ of the wavelength of the ultrasound wave, can effectively prevent membranous "flexural plate wave modes" or Lamb modes from developing. With the method according to the present invention the-ultrasound passes-through the solid-body layer directly into the microcavity where it generates a sound-induced flow. The use of high frequency also guarantees that sound absorption in the liquid is considerable.

The liquid to be thoroughly mixed is not in direct contact with the sound-generating or respectively sound-compromising medium. Contamination from multiple use is therefore excluded.

With the method according to the present invention effective thorough mixing can be achieved with outputs typically less than 50 Milliwatt per cavity. With good acoustic adaptation the value can also be reduced to less than 5 Milliwatt per cavity.

A separate substrate, for example made of plastic, metal or glass, can be used as solid-body layer. Depending on the used ultrasound wavelength the thicknesses are for example in the range of 0.1 mm to a few cm. Typical ultrasound waves lengths lie in the range of 10 μm to 100 μm. The solid-body layer can also be formed directly for example by the floor of a microcavity or the floor of a microtitre plate, which can be adjusted if required to a desired thickness or respectively ground, or respectively can comprise the floor.

The piezoelectric ultrasonic transducer can be excited either monochromatically by applying a high-frequency signal of resonance energy or respectively a harmonic (continuously or pulsed). By changing the frequency or amplitude the resulting mixing pattern can be influenced. Storing the resonance frequency of the ultrasonic transducer additionally boosts the efficiency of converting the electrical power into acoustic energy.

A needle impulse can be utilised to advantage here also, which as a-rule also has, apart from many other Fourier coefficients, those which can resonantly excite the ultrasonic transducer. This reduces the requirement for the required electronics, as no special frequency needs to be set.

The ultrasound absorption in the liquid to be mixed is particularly effective if the wavelength of the ultrasound wave is selected such that in the liquid it is less than or equal to the average filling level in the microcavity.

The ultrasonic transducer can be designed full-surface under the solid-body layer. However it is particularly advantageous if lateral expansion of the ultrasonic transducer is less than the lateral dimension of the microcavity used. Firstly, in the case of a larger ultrasonic transducer the capacitive portion of its impedance is increased, whereby the electrical adaptation changes, and secondly the mixing efficiency is less if the lateral dimension of the ultrasonic transducer is greater than the lateral dimension of the microcavity. If the lateral dimension of the ultrasonic transducer on the other hand is less than the lateral dimension of the microcavity, the ultrasound beam has less lateral expansion than the lateral dimension of the microcavity. Offset from the upwards directed ultrasound beam the liquid can flow back down again, resulting in optimal thorough mixing of the liquid. For instance the ultrasound wave can be input centrally from below into the microcavity, so that the liquid moves centrally upwards in the microcavity and can flow back down again at the edge of the microcavity.

The latter effect can be achieved in an alternative method, in that between the ultrasonic transducer and the microcavity an intermediate layer is introduced, which comprises a sound-absorbing material in an arrangement, enabling the ultrasound to propagate only in a limited spatial area, in the direction of the microcavity. Examples for advantageous sound-absorbing media are silicon, rubber, silicon rubber, soft PVC, wax or the like.

A liquid or solid equilibrium medium, for example water, oil, glycerine, silicon, epoxide resin or a gel film, can be introduced in between the microcavity and the solid-body material, to balance out any unevenness and to ensure secure acoustic contact.

Eppendorf caps or pipette tips or other microreactors can be used as microcavities, for example. So as to parallelise the process, several microcavities can be used at the same time. The use of a microtitre plate, which already provides a large number of cavities in a preset modular dimension, is particularly advantageous.

Likewise, several microcavities can be defined on a glass slide, for example by means of an adhesive foil with holes, preferably in the size of a conventional microtitre plate. For the purposes of the present text the term "microtitre plate" should include such an arrangement. In such an embodiment for example the glass slide can be used directly as solid-body layer, which is radiated through by the ultrasound wave. In this way a particularly compact arrangement can be realised. An adhesive foil with only one hole is used to realise only one microcavity in similar fashion.

The method according to the present invention can also be performed with a device similar to a microtitre plate, in which on a substrate of part areas a field is provided, which are wet preferably by the liquid to be thoroughly mixed and thus serve as anchoring for the liquid to be thoroughly mixed. If these fields are arranged in the modular dimension of a conventional microtitre plate, lateral distribution of the liquid results as in the case of a conventional microtitre plate after the liquid is deposited, whereby individual drops are held together by their surface tension. In the present text the term "microtitre plate" is to include such a design.

A microtitre plate can be set on the solid-body layer. If for example only one ultrasonic transducer is present, the microtitre plate on the solid-body layer can be moved to expose different cavities to ultrasound. In this way an individual selection can be made as to which microcavity is to be subjected to thorough mixing.

In a particular configuration of the method for example a field of piezoelectric ultrasonic transducers, which have the same arrangement as the cavities of a microtitre plate, is set under the solid-body layer for thorough mixing of liquids in the individual cavities of a microtitre plate. If these ultrasonic transducers are controlled individually the liquids in the individual cavities can be intermixed independently. Such a field of piezoelectric ultrasonic transducers can easily be integrated into automating solutions.

In another advantageous execution of the method ultrasound is input into the solid-body layer by means of an ultrasound wave generation device such that ultrasound output can be input at least at two output points from the solid-body layer in a corresponding number of microcavities. This can be accomplished for example by an ultrasound wave generation device, which radiates bidirectionally. In an embodiment of the invention the ultrasound wave is generated on a piezoelectric crystal, arranged on a piezoelectric crystal, by means of a surface wave generation device, preferably an interdigital transducer.

The piezoelectric crystal supporting the interdigital transducer can be adhered to, pressed on or bonded to the solid-body layer, or can be adhered to, pressed on or bonded to the solid-body layer via an input medium (for example electrostatically or via a gel film).

Such interdigital transducer are metallic electrodes designed comblike, whereof the double finger distance defines the wavelength of the surface sound wave and which can be made by the optical photolithography method for example in the vicinity of the 10 μm finger distance. Such interdigital transducers are provided for example on piezoelectric crystals to excite surface sound waves thereon in a manner known per se.

Volume sound waves, which pass obliquely through the solid-body layer, can be generated therein in a different way by means of such an interdigital transducer. The interdigital transducer generates a bidirectionally radiating boundary surface wave (LSAW) at the boundary surface between the piezoelectric crystal and the solid-body layer, on which it is set. This boundary surface leaky wave radiates energy as volume sound waves (BAW) in the solid-body layer. Thereby the amplitude of the LSAW decreases exponentially, whereby typical fade lengths are approximately 100 μm. The radiation angle α of the volume sound waves in the solid-body layer measured against the normal of the solid-body layer results from the arcussinus of the ratio of the speed of sound $V_S$ of the volume sound wave in the solid-body layer and the sound wave $V_{SAW}$ of the boundary surface sound wave generated with the interdigital transducer ($\alpha=\arcsin(V_s/V_{LSAW})$). Radiation in the solid-body layer is therefore possible only if the speed of sound in the solid-body layer is less than the speed of sound of the boundary surface leaky wave. As a rule, therefore transversal waves are excited in the solid-body layer, since the longitudinal speed of sound in the solid-body layer is greater then the speed of the boundary surface leaky wave. A typical value for the boundary surface leaky wave speed is for example 3900 m/s.

The piezoelectrically caused deformations in the piezoelectric crystal under the interdigital transducer fingers engaging in one another like combs radiate volume sound waves (BAW) also directly in the solid-body layer. In this case a radiation angle a results measured against the normal of the solid-body layer as arcussinus of the ratio on the one hand to the speed of sound in the solid-body layer $V_s$ and on the other hand to the product from the period of the interdigital transducer $I_{IDT}$ and the applied high frequency f ($\alpha=\arcsin(V_s/(I_{IDT}\cdot f))$). For this sound input mechanism the angle of incidence can be preset relative to the normal of the solid-body layer, the angle of levitation, therefore by the frequency. Both effects can occur in proximity to one another.

Both mechanisms (LSAW, BAW) enable oblique irradiation of the solid-body layer. The whole electrical contacting of the interdigital transducer can take place on the side of the solid-body layer facing away from the microcavity or respectively the liquid.

In an easy-to-realise embodiment the interdigital transducer is on the piezoelectric element on a side facing away from the solid-body layer of the microcavity. On account of the described oblique inputting of the ultrasound wave in the solid-body layer geometries are also possible, in which the interdigital transducer with the piezoelectric element is arranged on a front face of the solid-body layer.

It is particularly advantageous if the material of the solid-body layer to be investigated by ultrasonic transmission, with respect to the acoustic damping with the frequencies used and the reflection properties of the boundary surfaces, is selected such that partial reflection of an oblique input ultrasound wave takes place. For example a equilibrium medium between microtitre plate and solid-body layer can be provided, so that a boundary surface is set between equilibrium medium and solid-body layer to be investigated by ultrasonic transmission, wherein a reflection coefficient of for example 80% to 90% is set for an ultrasound wave of the frequency used, so that 10% to 20% of the ultrasound wave running in the solid-body layer is output and the rest is reflected. Taking place between solid-body layer and air on the other boundary surface of the solid-body layer as a rule is an almost 100% reflection. In another configuration, in which the floor of the microtitre plate itself is used as solid-body layer to be investigated by ultrasonic transmission, 10% to 20% of the ultrasound output is output from the floor of the microtitre plate serving as solid-body layer in the liquid in each microcavity, and the rest is reflected in the floor of the microtitre plate.

Due to the reflection at the boundary surfaces the ultrasound wave is guided through the solid-body layer as in a waveguide. Where the ultrasound wave encounters the boundary surface between solid-body layer and equilibrium medium or respectively solid-body layer and liquid in one of the microcavities, a part of the ultrasound output is output. Through appropriate selection of the geometries, for example the thickness of the solid-body-layer or respectively of the floor of the microtitre plate, the output sites of the ultrasound output defined in this way can be ascertained precisely. In such a method therefore for example several microcavities of a microtitre plate are exposed to ultrasonic waves with ultrasound output at the same time, without a large number of ultrasonic transducers being necessary. Problems, which can occur for example with the wiring of a plurality of ultrasonic transducers, are avoided in this way.

The use of quartz glass has proven to be advantageous for example on account of minimal damping as a solid-body layer at a frequency of 10 MHz to 250 MHz. Whereas in such a case almost 100% is reflected at the solid-body layer/air boundary surface, at the solid-body layer/liquid boundary surface (therefore for example equilibrium medium or respectively the liquid in the microcavity) a certain percentage of the acoustic energy in the respective liquid is output.

Use of interdigital transducers with non-constant finger distance ("tapered interdigital transducers"), as described for another application for example in WO 01/20781 A1, enable the selection of the radiation site of the interdigital transducer by means of the applied frequency. In this way it can be established precisely at which place the ultrasound wave exits from the solid-body layer. With use of a tapered interdigital transducer, which additionally does not have straight finger electrodes, finger electrodes engaging in one another in particular for example in a curved manner, the azimuthal angle 0 can be regulated by variation of the operating frequency. On the other hand the angle of levitation a can change with the frequency by direct BAW generation on the interdigital transducer.

Individual microcavities of a microtitre plate for thorough mixing can be selected very precisely for example by means of the described setting of the direction of radiation by selection of the frequency, if required using accordingly formed interdigital transducers. A temporal sequence of the mixing place can be preset by time variation of the operating frequency.

Positioned on the piezoelectric element for example are one or more interdigital transducers for generating the ultrasound waves which are either contacted separately or are contacted jointly in series or in parallel to one another. For example, in the instance of a different finger electrode distance the former can be controlled separately by the selection of the frequency and thus also offer the possibility of the selection of specific areas.

To prevent reflections from occurring at unwanted places of the solid-body layer in an uncontrolled way (that is for example on front faces), the ultrasound wave can be diffusively scattered through appropriate selection of a diffusively scattering surface of the solid-body layer. For this the corresponding surface is roughened, for example. Such a roughened surface can also be used specifically to broaden the ultrasound wave, in order to expose a larger surface to ultrasonic waves.

Suitably angularly arranged lateral front faces of the solid-body layer can be used for targeted reflection and deflect the acoustic beam in a defined manner.

In particular with respect to manufacturing costs and geometry in the simultaneously well-defined direction of irradiation in the solid-body layer with another configuration of the method according to the present invention the use of a piezoelectric volume oscillator, for example a piezoelectric thickness oscillator, can also prove to be advantageous.

A device according to the present invention for carrying out the method according to the present invention has a substrate, on the main surface whereof at least one piezoelectric acoustic modulator is arranged, which can be excited for electrically generating an ultrasound wave of a frequency greater than or equal to 10 MHz, whereby the thickness of the substrate in the direction of sound propagation is greater than ¼ of the ultrasound wavelength. The substrate can be designed separately or can for example be formed by the floor of a microtitre plate or a microcavity.

The substrate can for example also comprise a glass slide, to which an adhesive foil with preferably periodically arranged holes is attached, so as to obtain an arrangement of microcavities. Such a glass slide with a stuck-on perforated adhesive foil can be used as a microtitre plate.

It is particularly advantageous if a plurality of piezoelectric ultrasonic transducers is used in the modular dimension of a microtitre plate to expose the microcavities of a microtitre plate parallel to ultrasound.

To be able to control individual ultrasonic transducers individually, a switching mechanism is advantageously provided, which applies electrical high frequency power to individual ultrasonic transducers.

Advantages of other embodiments of the device according to the present invention for carrying out the different configurations of the method according to the present invention result from the advantages and properties described for corresponding methods.

BRIEF DESCRIPTION OF THE DRAWINGS

Particular embodiments of the method according to the present invention or respectively of the device according to the present invention are explained in detail hereinbelow by means of the attached figures. The figures are of a schematic nature only and are not necessarily true to scale, in which.

DESCRIPTION OF THE PREFERRED EMBODIMENTS

Figure 1:
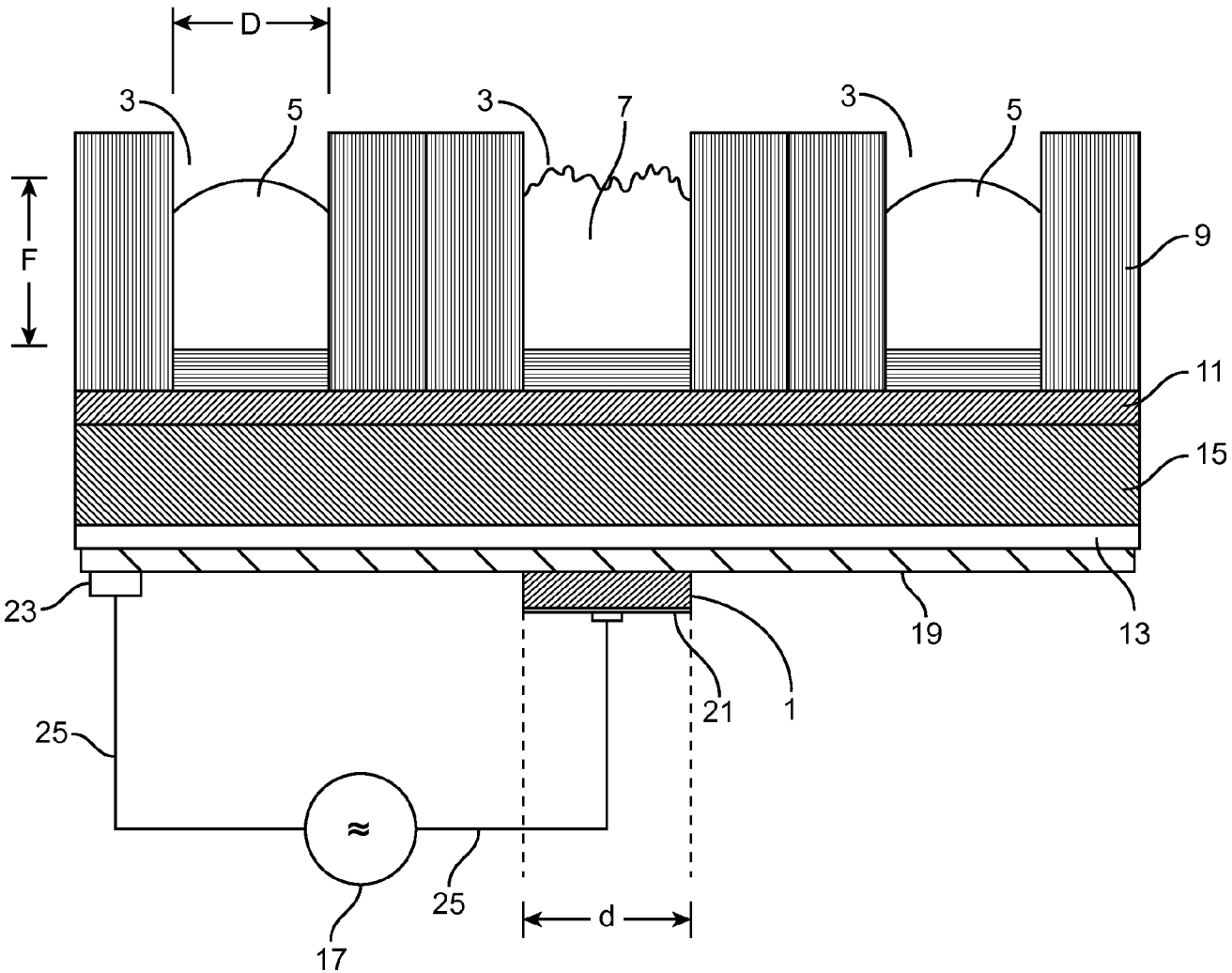
FIG. 1 illustrates the section of a cross-section of a device according to the present invention during performing a method according to the present invention.

FIG. 1 schematically illustrates an arrangement according to the present invention in cross-section. Reference numeral 1 illustrates a piezoelectric thickness oscillator, whereof the function will be explained with reference to FIG. 6. Reference numeral 9 designates the schematic cross-section through a microtitre plate in the area of the cavities 3. Shown here are three cavities, though microtitre plates as a rule have 96, 384 or 1536 cavities in a right-angular arrangement. The diameter D of an individual cavity 3 is greater than the diameter d of the piezoelectric thickness oscillator 1. For instance, the diameter D is a 96 microtitre plate 6 mm and the thickness oscillator has a diameter of 3 mm. In the microcavities 3 of the microtitre plate 9 is a liquid 5. Shown here is the liquid with an upwards arched surface, due to surface tension. Reference numeral F designates the average filling level in an individual microcavity. Located between the thickness oscillator and the microcavities is solid-body material 15, for example made of plastic, metal or glass for protecting the thickness oscillator or respectively the contacts. Reference numeral 19 designates a flat electrode under the substrate 15. This electrode forms an electrical connection for the piezoelectric thickness oscillator 1.

The other electrode of the thickness oscillator is designated with 21. The electrodes 19, 21 are connected to the high frequency generator 17 via electrical connections 23, 25. On the main surfaces of the substrate 15 is an optional input medium 11, 13, for example water, oil, glycerine, silicon, epoxide resin or a gel film, for balancing out unevenness in the individual layers and guaranteeing optimal sound input.

What is shown is a state in which the thickness oscillator 1 radiates an ultrasound wave in the direction of the average illustrated cavity, by which movement in the liquid 7 is generated.

Figure 2:
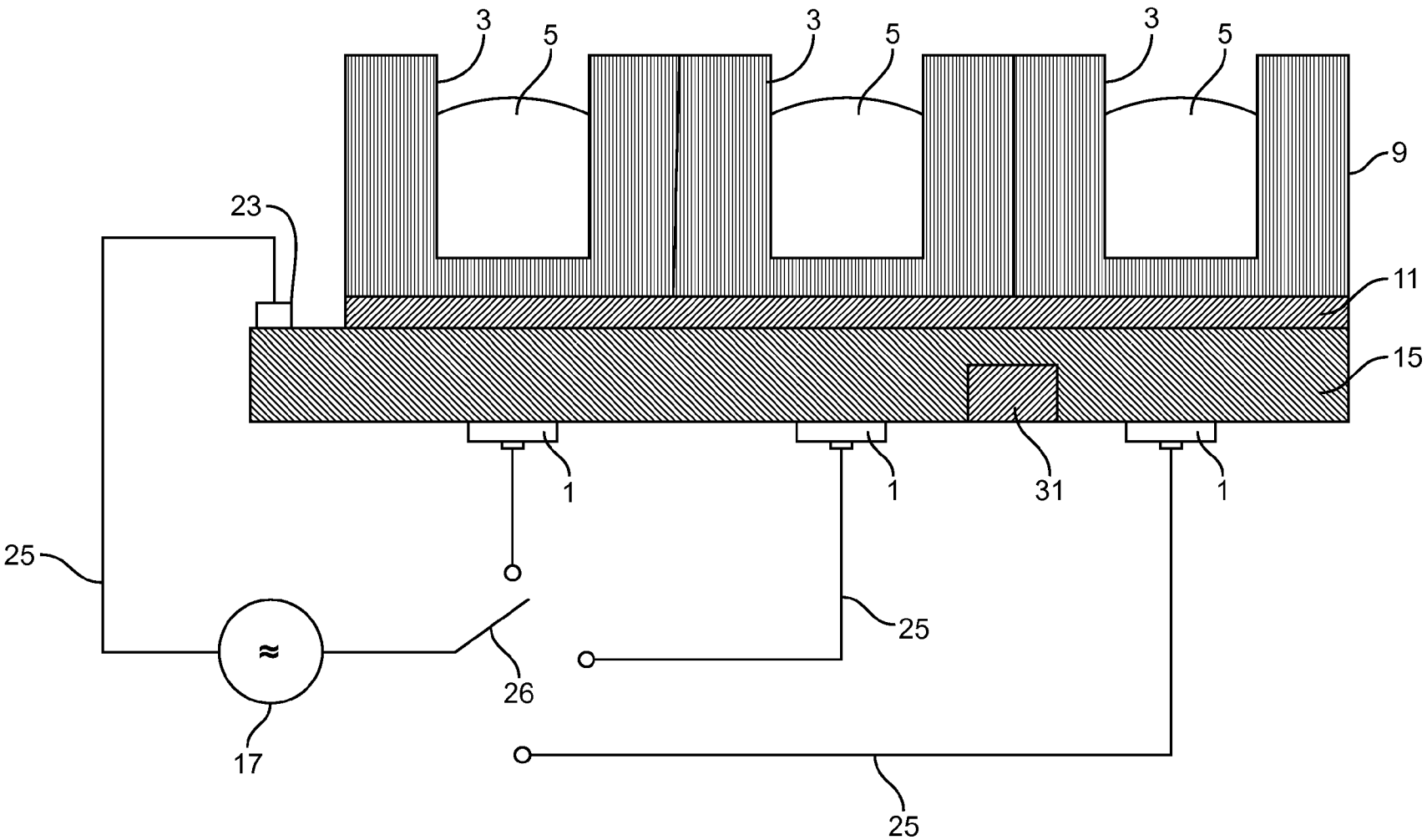
FIG. 2 illustrates the section of a cross-section of another embodiment of the device according to the present invention for carrying out a configuration of the method according to the present invention.

FIG. 2 illustrates another embodiment. Identical elements are designated with the same reference numerals. Individual thickness oscillator for the individual microcavities of the microtitre plate 9 are provided. By means of a switching mechanism 26 the high frequency signal of the high frequency generator 17 can be applied to the different thickness oscillators 1. Reference numeral 31 designates schematically an optional sound-absorbing medium, which prevents crosstalk. This sound-absorbing medium can be structuring or an accordingly selected plastic.

Figure 3:
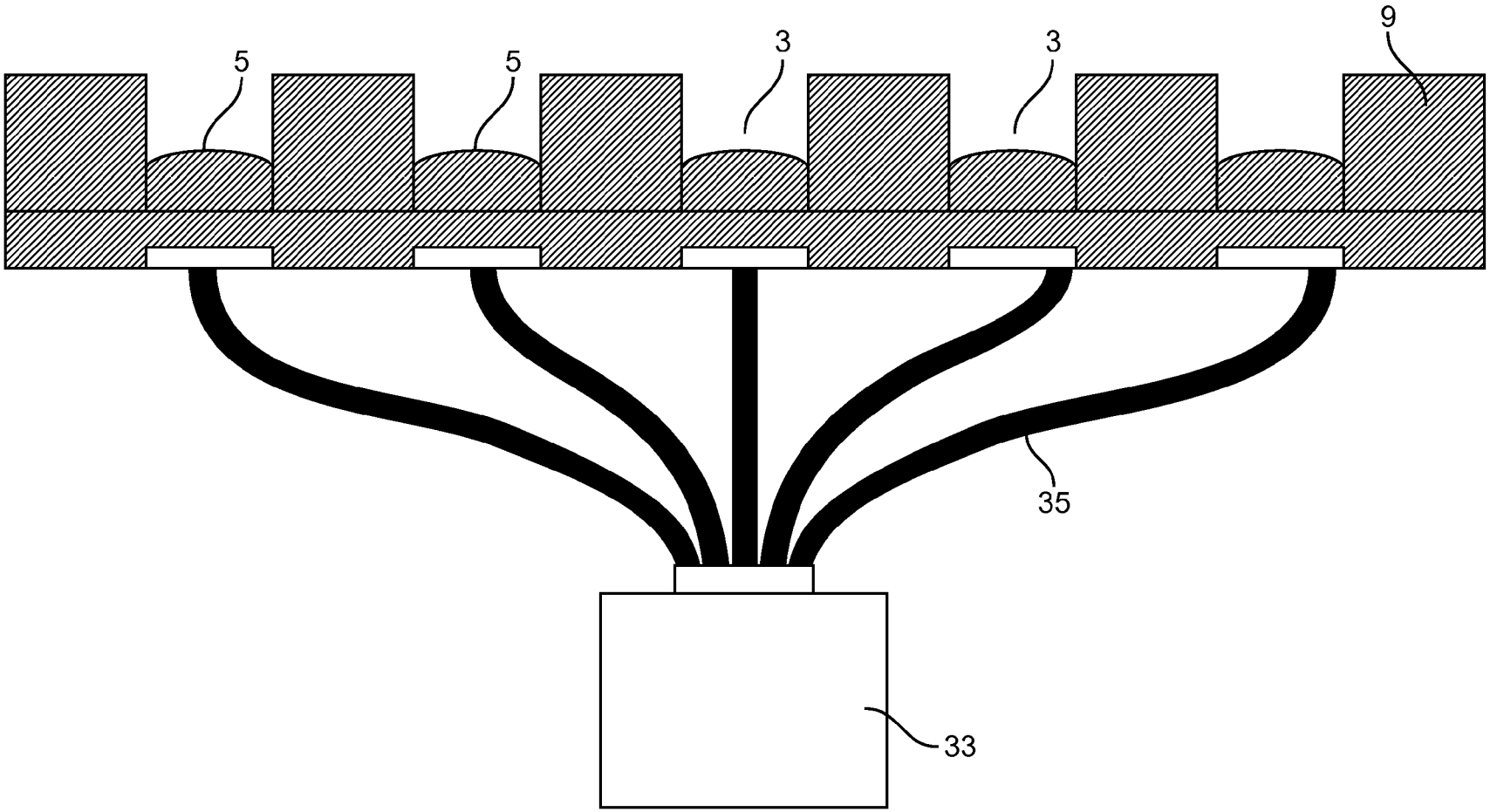
FIG. 3 illustrates the cross-section of a further embodiment of the device according to the present invention for carrying out a configuration of the method according to the present invention.

FIG. 3 illustrates an embodiment, in which one or more ultrasonic transducers 33 are employed, which are connected via waveguides 35 to the floors of various cavities. These waveguides preferably comprise a material with similar acoustic properties to the thickness oscillator itself, to optimise inputting, therefore metal rods, for example.

Figure 4A:
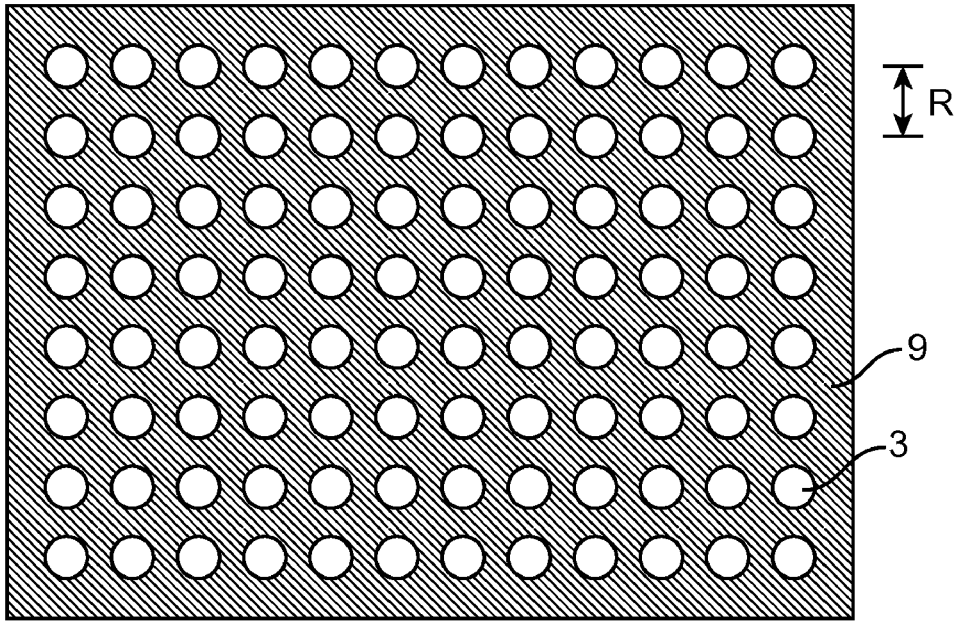
FIG. 4*a* illustrates the plan view of a microtitre plate for use with a device according to the present invention for carrying out a configuration of the method according to the present invention.
Figure 4B:
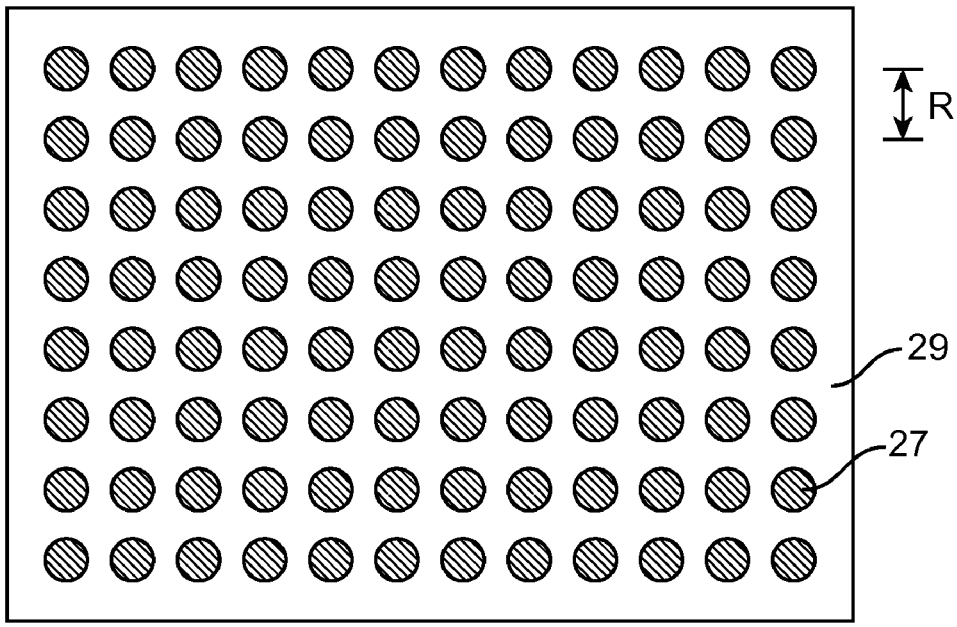
FIG. 4*b* illustrates the arrangement a field of a piezoelectric volume oscillator according to an embodiment of the device according to the present invention for carrying out a configuration of the method according to the present invention.

FIG. 4 illustrates the arrangement in a grid. FIG. 4*a* illustrates the plan view of a microtitre plate with 96 cavities. FIG. 4*b* illustrates the plan view of the arrangement of individual piezoelectric thickness oscillators 27 on a substrate 29. The modular dimension of the microtitre plate R is also kept for the distance of the piezoelectric thickness oscillator 27. Alternatively, the thickness oscillator can be arranged full-surface on the substrate 29 and only the electrode array may correspond to the pattern of the microtitre plate.

Figure 5:
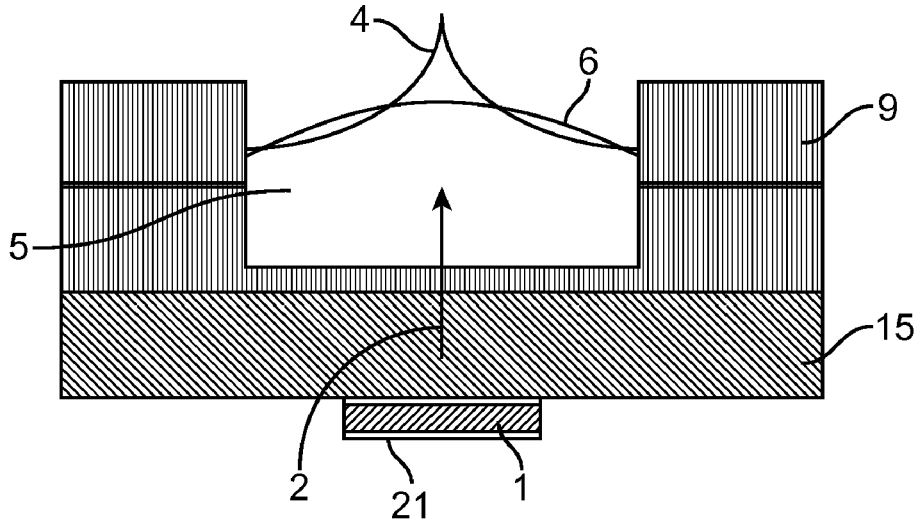
FIG. 5 illustrates the operation of a device according to the present invention or respectively a method according to the present invention in an example of an individual microcavity.

FIG. 5 illustrates in detail the cross-section through an individual microcavity for clarity. Here reference numeral 2 illustrates the ultrasound wave, radiated by the thickness oscillator. Reference numeral 6 designates the meniscus without incident ultrasound wave and reference numeral 4 illustrates the meniscus during incident radiation. The thickness of the substrate 15 including the possible input media 11, 13 is greater than ¼ the wavelength of the ultrasound wave in the substrate, which is typically in the range of a few 100 μm. Metal, such as aluminium, glass or plastic, come into consideration as materials for the substrate, for example. "Thickness" is understood to mean the thickness of the substrate 15 in the direction of sound propagation. In a substrate made of aluminium the wavelength of a 20 MHz-sound wave is for example 315 μm, in glass it is 275 μm and in plastic it is 125 μm.

Figure 6:
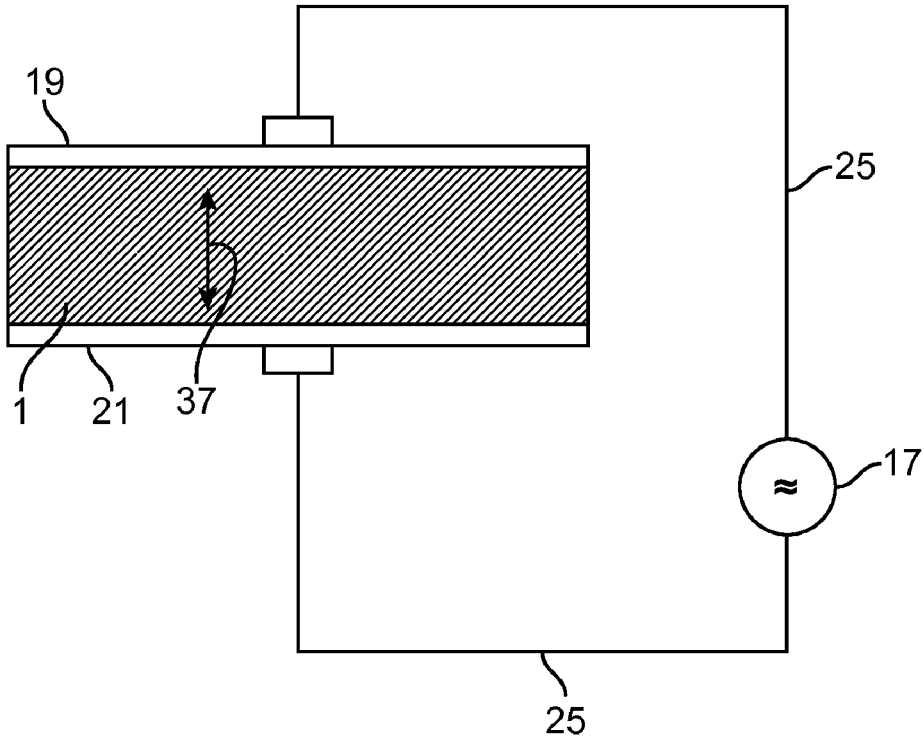
FIG. 6 illustrates an explanatory sketch for operation of a piezoelectric thickness oscillator, as can be used with the method according to the present invention.

FIG. 6 explains the principle of the piezoelectric thickness oscillator 1. When a high frequency field is applied by means of the high frequency generator 17 to the electrodes 19, 21 of the thickness oscillator an ultrasound wave is generated perpendicularly to the surface expansion of the thickness oscillator. The direction of oscillation is designated with 37. With a thickness of the thickness oscillator of for example 200 μm a wavelength of 400 μm results when the fundamental oscillation is excited. Examples of materials are piezoelectric single crystals, for example quartz, lithium niobate or lithium tantalate. Other oscillators have piezoelectric layers, for example cadmium sulphide or zinc sulphide or piezoelectric ceramics, for example lead-zirconate-titanate, barium titanate or in each case with admixtures for optimising the speed of sound on the solid body. Piezoelectric polymers (for example polyvinylidendifluoride) or composite materials are possible. It is particularly advantageous if the material of the solid body 15 or respectively the microtitre plate 9 is adapted acoustically to the ultrasonic transducer, therefore has similar speed of sound and thickness.

Figure 7A:
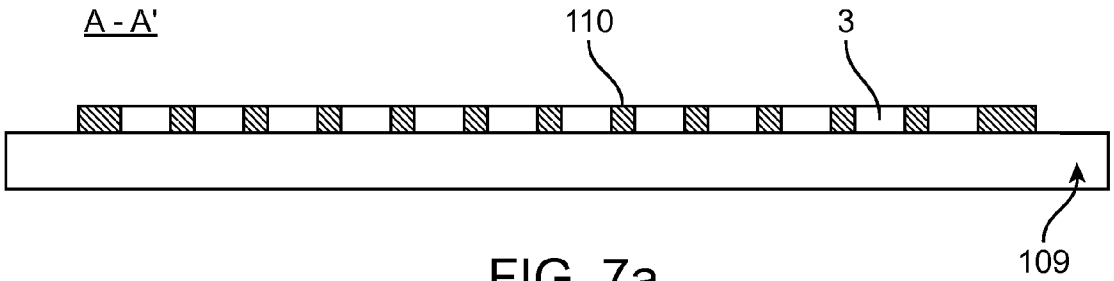
FIG. 7*a* illustrates a sectional view through a device for definition of a periodic arrangement of microcavities.
Figure 7B:
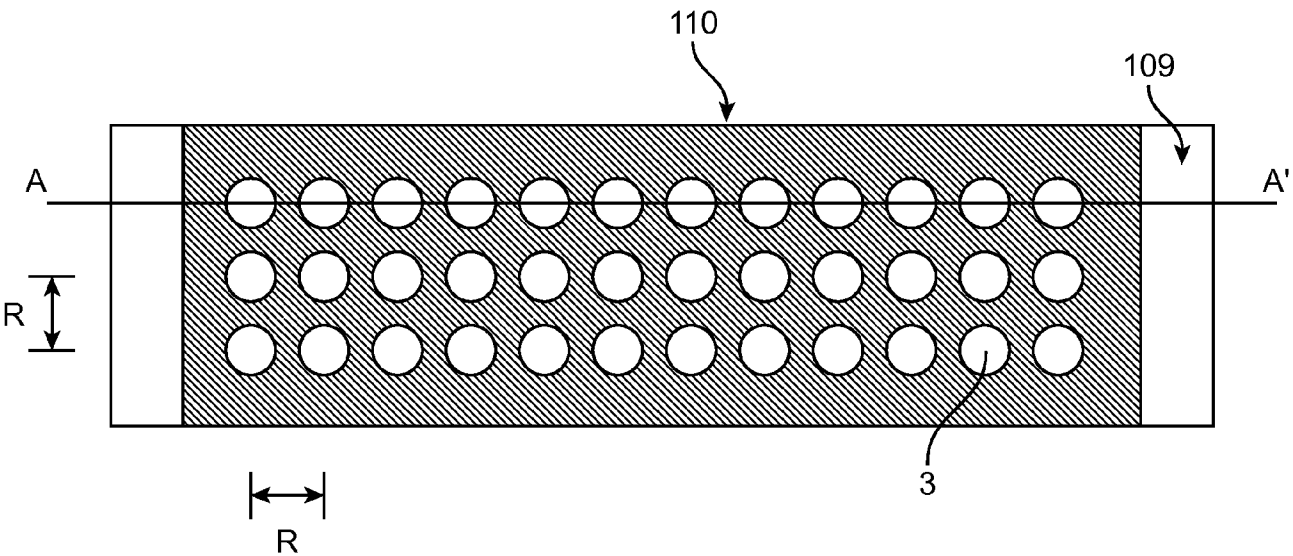
FIG. 7*b* illustrates a plan view of the device of FIG. 7*a*.

FIG. 7 illustrates a mechanism, which can be utilised like a one-piece microtitre plate. A perforated adhesive foil 110 is arranged on a glass slide 109 (for example a slide support). FIG. 7*b* illustrates a plan view, in which the sectional direction A-A' of the section indicated in FIG. 7*a* is indicated. The modular dimension R of the holes corresponds for example to the modular dimension of a conventional microtitre plate. The periodically arranged holes 3 define microcavities, as are also present in a microtitre plate. A device of FIG. 7 can be used like a microtitre plate and for the purposes of the present text the term "microtitre plate" also includes a corresponding arrangement.

The method according to the present invention can be carried out with the above-described device according to the present invention as follows.

The microtitre plate 9 is set on the substrate 15. For optimal comparison of unevenness an equilibrium medium 11, for example water, can be arranged in between. The microtitre plate 9 is placed such that it is arranged with a cavity 3 above the piezoelectric thickness oscillator 1 (FIG. 1). The liquid 5 is introduced to the microcavities 3, whereby attention is paid that the filling level F is sufficiently high so a to be greater than the wavelength of the ultrasound which can be generated with the thickness oscillator. Applying high frequency to the electrodes 19, 21 of the thickness oscillator 1 by means of the high-frequency generator 17 creates an ultrasound wave perpendicular to the thickness oscillator 1, which spreads out in the direction of the average shown cavity 3 and causes thorough mixing of the liquid 7 contained therein.

The ultrasound beam, whereof the lateral expansion is the size of the thickness oscillator 1, encounters the microcavity 3 from below and generates a pulse and a flow in the liquid in an upwards direction, which can lead to deformation of the meniscus 4 (see FIG. 5). Laterally to the upwards directed ultrasound beam the liquid can flow back down, thereby creating thorough mixing of the liquid.

After thorough mixing of the liquid in a microcavity the microtitre plate is offset if required, in order to expose another microcavity to the ultrasound.

In an embodiment of FIG. 2 the microtitre plate 9 is likewise set on the substrate 15. The microcavity, whereof the liquid is to be thoroughly mixed, can be selected by means of the switching mechanism 26. FIG. 4*b* illustrates the plan view of an arrangement of the piezoelectric thickness oscillator 27 used for this purpose.

In an embodiment of FIG. 3 the ultrasound is generated by means of the ultrasound sender 33 and led via the waveguide 25 under the microcavities which are exposed to ultrasonic waves at the same time.

The high frequency exciting can occur in all configurations also in the form of an intensive needle pulse. This contains four Fourier coefficients, so that the resonance frequency of the thickness oscillator 1 is also affected. Alternatively, the high frequency signal is fed identically with the resonance frequency of the thickness oscillator or respectively a harmonic. Typical frequencies lie in the range of greater than or equal to 10 MHz. Power loss, in the form of heat, resulting from operation of the piezoelectric thickness oscillator can, if not wanted, very easily be discharged by the thickness oscillator being mounted on a cooling body.

Figure 8A:
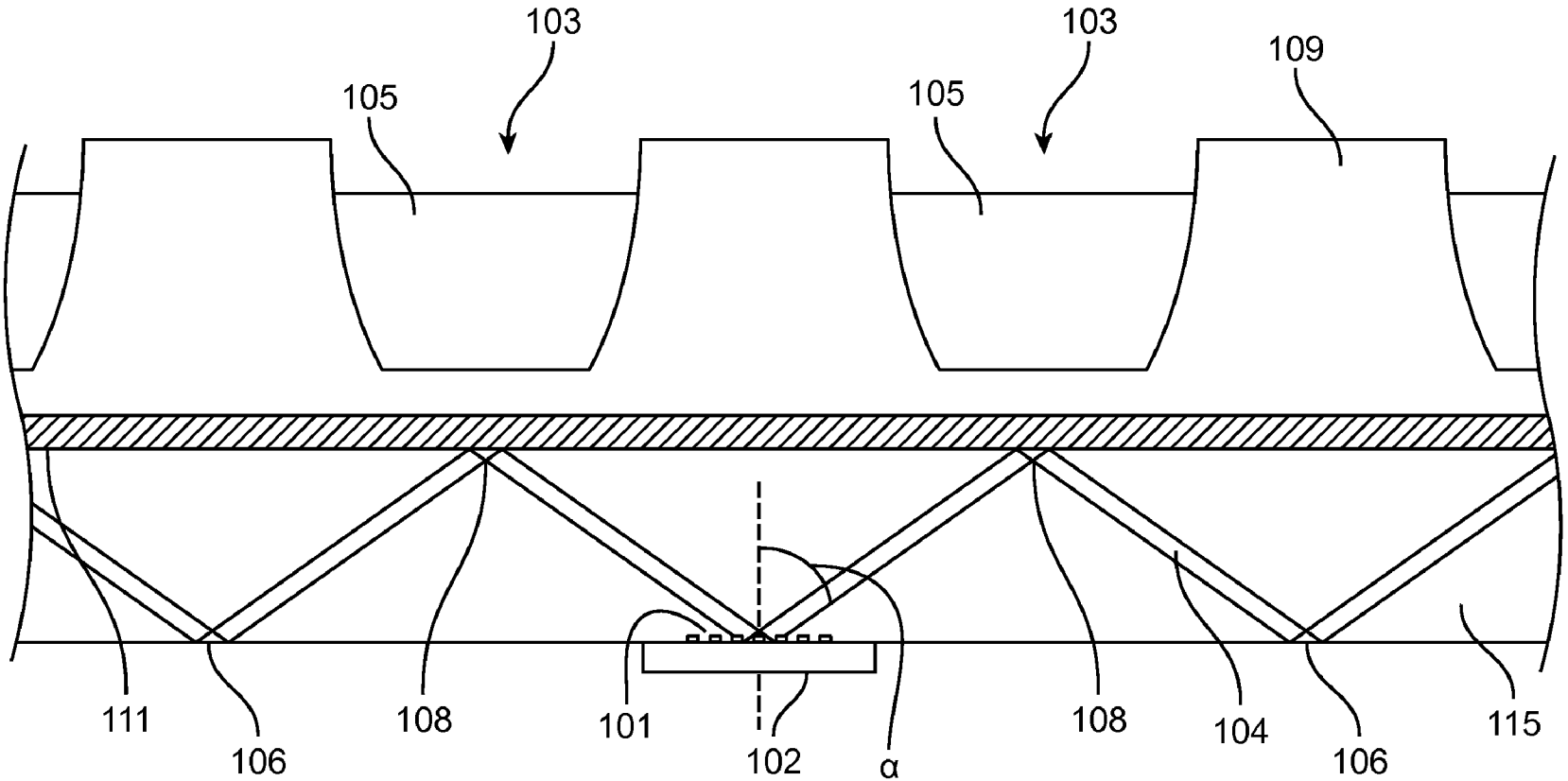
FIG. 8*a* illustrates a cross-sectional view of a further arrangement for carrying out a method according to the present invention.

FIG. 8*a* illustrates a design, in which an interdigital transducer 101, only schematically illustrated, for generating the sound wave is used. Reference numeral 115 designates the substrate, for example made of quartz glass. Reference numeral 102 is a piezoelectric crystal element, for example made of lithium niobate. Located on the piezoelectric crystal element 102 and thus between the piezoelectric crystal element 102 and the substrate 115 is an interdigital transducer 101, which for example was placed in advance on the piezoelectric crystal 102. An interdigital transducer is generally formed by metallic electrodes engaging in one another comb-like, whereof the double finger distance defines the wavelength of a surface sound wave, which are by application of a high-frequency alternating field (in the range of for example a few MHz to a few 100 MHz) to the interdigital transducer in the piezoelectric crystal. For the purposes of the present text the term "surface sound wave" is also understood to mean boundary surface waves on the boundary surface between piezoelectric element 102 and substrate 115. A material of lesser acoustic damping is used in the frequencies used as a substrate 115. For example, quartz glass is suitable for frequencies in the range of 10 MHz to 250 MHz. Interdigital transducers are described in DE-A-101 17 772 and known from surface wave filter technology. Metallic supply lines, not shown in FIG. 8*a* and explained in greater detail with respect to FIG. 17, act as connection for electrodes of the interdigital transducer 101.

Ultrasound waves 104 can be generated in the given direction by means of the bidirectionally radiating interdigital transducer 101, which waves pass through the glass body 115 as described hereinabove at an angle $\alpha$ to the normal of the substrate 115 volume sound waves. Reference numeral 111 designates an optional input medium between the glass body 115 and the microtitre plate 109, as described above for another embodiment. Reference numeral 108 designates the areas of the boundary surface between glass body 115 and input medium 111, which are affected essentially by the volume sound waves 104. Reference numeral 106 designates the reflection points on the substrate 115/air boundary surface. Reference numeral 109 describes a microtitre plate, in the cavities 103 whereof the liquid 105 is situated.

By means of the interdigital transducer 101, on which the high frequency is applied by way of the supply lines not shown in FIG. 8*a* in known manner, volume sound waves 104 running obliquely into the substrate are generated. At the points 108 these encounter the boundary surface between substrate 115 and input medium 111. Suitable selection of the substrate material 115 causes part of the ultrasound wave 104 to be reflected at the points 108 and another part to be output. At the same time the materials are selected such that partial reflection takes place on the boundary surface between substrate 115 and input medium 111, on the boundary surface between substrate 115 and air, therefore at the points 106, almost complete reflection. For example, with use of $SiO_2$ glass a reflection factor results on the boundary surface between input medium and glass of ca. 80% to 90%, therefore inputting in the input medium of ca. 10% to 20%. Assuming a reflection factor of 80% the intensity of the beam 104 reflected repeatedly in the glass substrate after ten reflections decreases by ca. 10 dB. At the same time, with a substrate thickness of 3 mm the beam has already covered a lateral distance of 250 mm. Through suitable selection of the geometry, for example the thickness of the substrate, the points 108, at which part of the ultrasound wave is input in the input medium from the substrate 115, can be ascertained precisely in this way and adapted to the modular dimension of the used microtitre plate 109.

In an alternative, not shown, the floor of the microtitre plate 109 itself acts as substrate, on the underside whereof the piezoelectric crystal 102 is attached or pressed. The ultrasound wave 104 is then input directly in the floor of the microtitre plate and on the boundary surface, formed by the floor of the individual microcavities, output in the liquid, as described for the illustrated embodiment for inputting in the input medium.

Figure 8B:
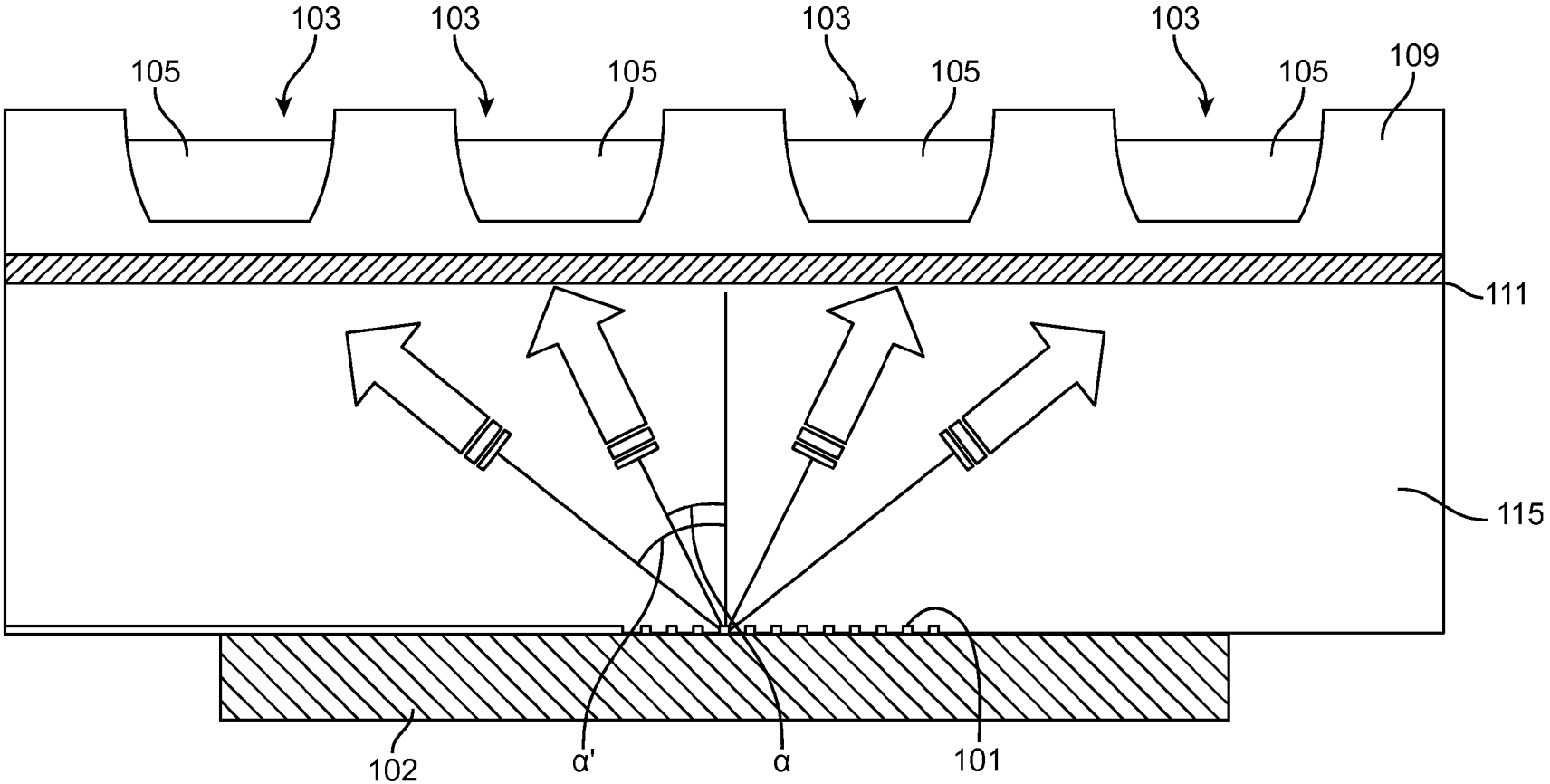
FIG. 8*b* illustrates a cross-sectional view of an arrangement for carrying out a method according to the present invention for explaining a particular operating method.

FIG. 8*b* serves to elucidate and point out how different input angles can be set with an embodiment of FIG. 8*a* through selection of different frequencies. With direct exciting of volume modes (BAW) and through variation of the exciting frequency the radiation angle a can be set in the substrate 115. The interdigital transducer 101 can be a simple normal interdigital transducer, whereby the angle of levitation a is set according to the interrelationship $\sin\alpha = V_s/(I_{IDT} \cdot f)$, whereby $V_s$ is the speed of sound of the ultrasound wave, f is the frequency and $I_{IDT}$ is the periodicity of the interdigital transducer electrodes. Through variation of the frequency therefore the radiation angle can be altered for example from $\alpha$ to $\alpha'$. In this way the output points 108 can for example be adapted optimally to the modular dimension of a microtitre plate 109.

Figure 9:
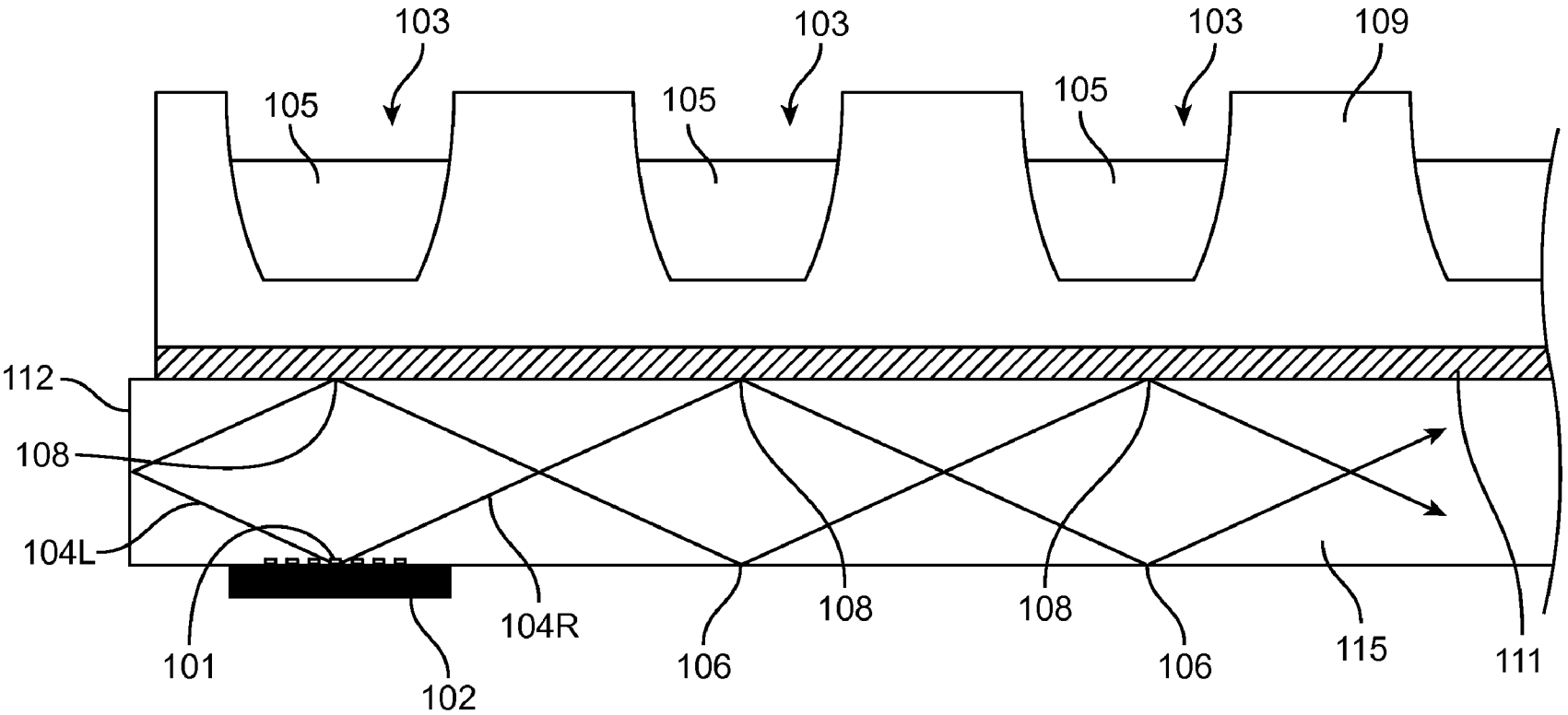
FIG. 9 illustrates a cross-sectional view of an alternative arrangement for carrying out a method according to the present invention.

FIG. 9 illustrates a variation of FIG. 8. A lateral sectional view is shown. A beam 104L goes out from the bidirectionally radiating interdigital transducer 101 in FIG. 9 to the left and a beam 104R to the right obliquely into the substrate 115. At the edge 112 of the substrate 115 the acoustic beam 104L is reflected and deflected in the direction of the boundary surface between substrate 115 and input medium 111. Through appropriate selection of geometry, for example the thickness of the substrate 115, the points of encounter 108 can likewise adapt to the modular dimension of a microtitre plate.

In an embodiment, not shown, the interdigital transducer 101 is located on the piezoelectric element 102 not on a main surface of the substrate 115, but on a front face, for example at the edge 112, as is evident in FIG. 9. In this way, two volume sound waves 104, which pass through the substrate 115 and can be used similarly to the method of operation shown in FIG. 9, are likewise generated with the bidirectionally radiating interdigital transducer 101.

Both in the embodiment of FIG. 8 and also in the embodiment of FIG. 9 several interdigital transducers can be arranged adjacently on one or more piezoelectric elements 102, so as to not only expose to ultrasonic waves a row of microcavities 103, but a field of adjacent rows, as corresponds to a conventional microtitre plate.

Figure 10A:
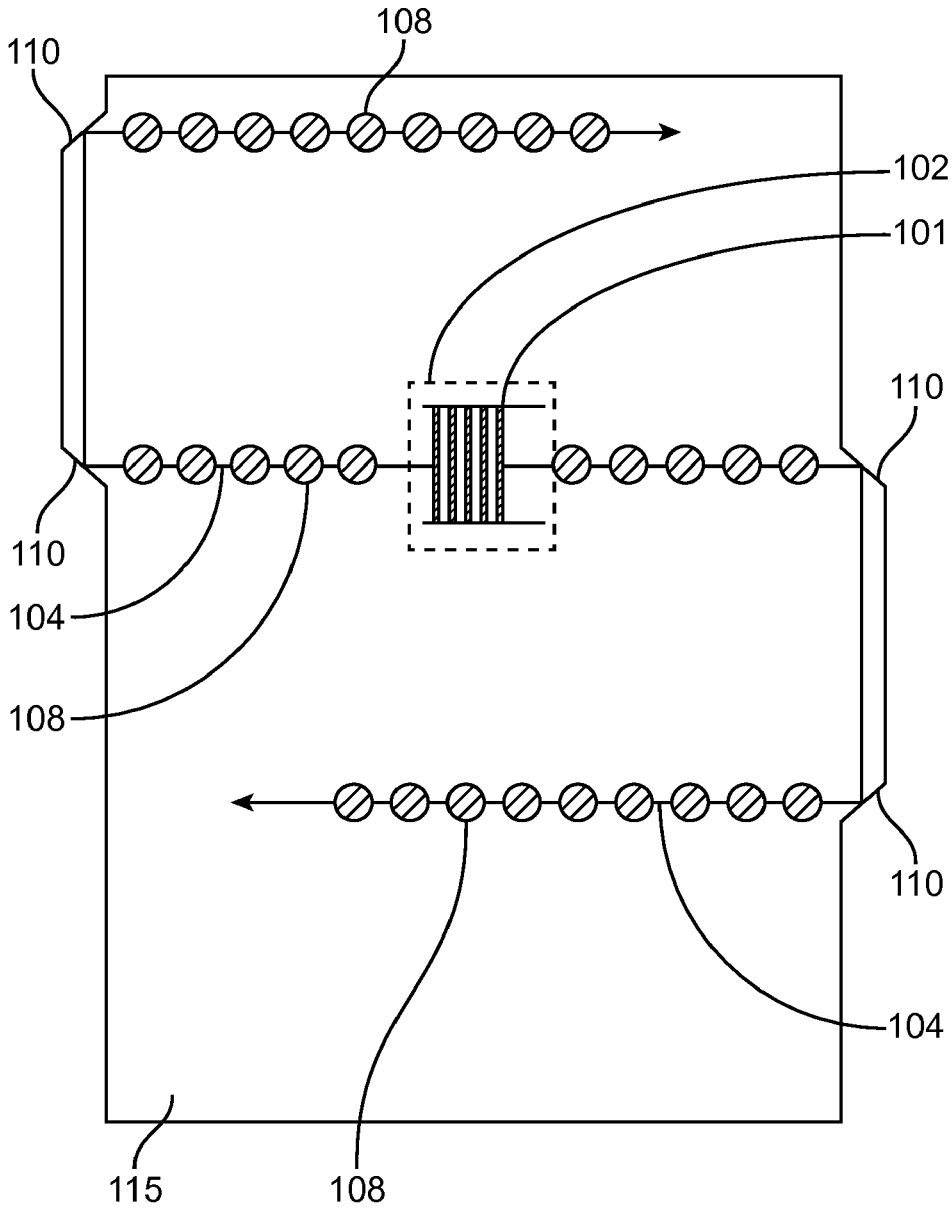
FIG. 10*a* illustrates a plan view of a cross-section of an arrangement for carrying out a configuration of the method according to the present invention.

FIG. 10*a* illustrates a plan view of a cross-section of an arrangement, approximately at the level of the surface of the substrate 115, which particularly enables deflection of the sound beam in the substrate 115. Sound beams 104, which encounter at points 108 the upper boundary surface of the substrate 115, go out from the interdigital transducer 101 as described with reference to FIG. 8. In the illustration of FIG. 8 the beam therefore is guided in the form of a zigzag line similarly to the sectional illustration in FIG. 8*a* through the substrate 115. The acoustic beam 104 thus guided is deflected at boundary surfaces 110 of the substrate 115. Through appropriate geometry of the surfaces 110 a desired pattern of motion of the sound beam can be generated.

Figure 10B:
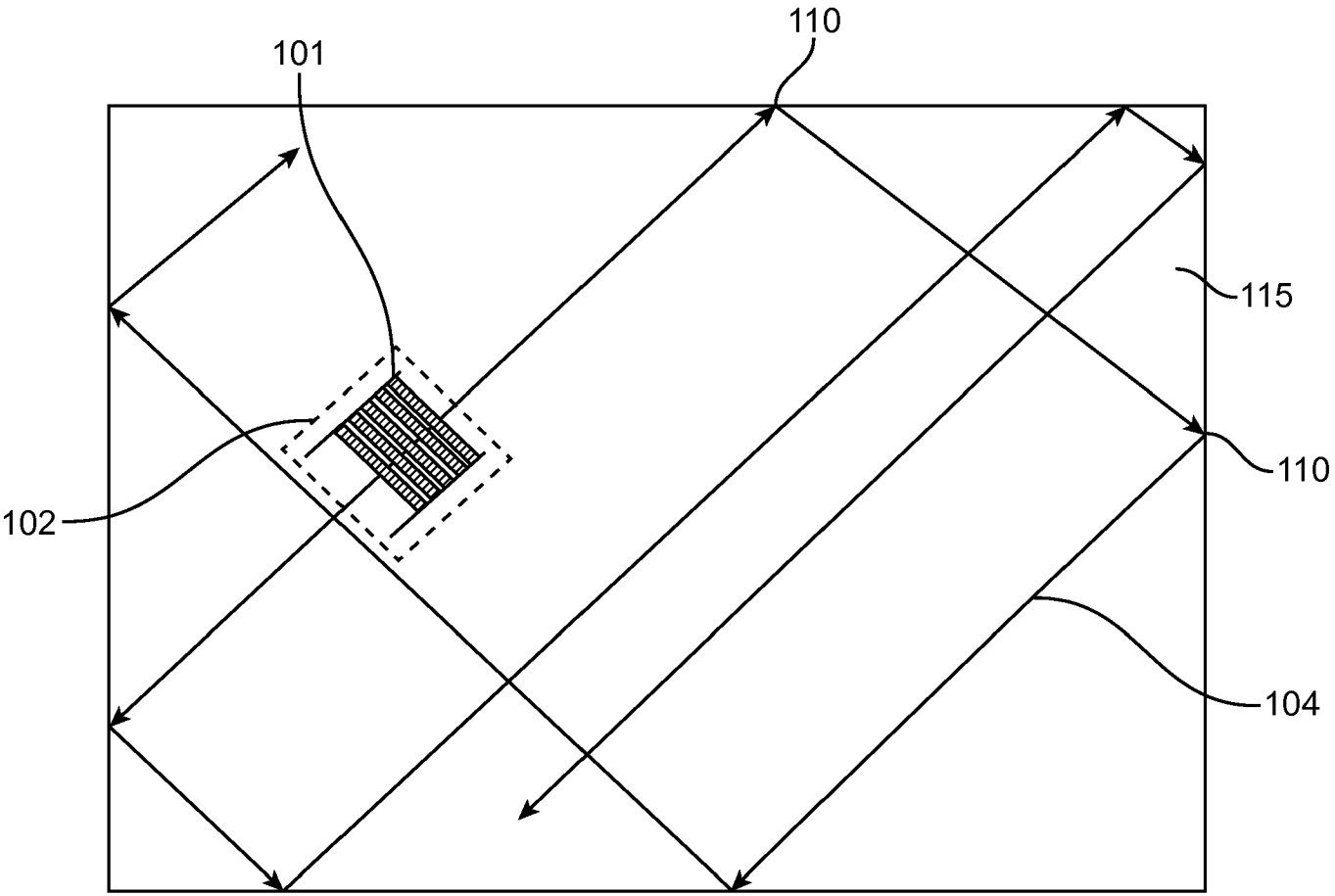
FIG. 10*b* illustrates a plan view of a cross-section of a further arrangement for carrying out a configuration of the method according to the present invention.

FIG. 10*b* shows an arrangement, wherein a flat substrate 115 can be covered almost completely by means of only one bidirectionally radiating interdigital transducer 101, whereby this is achieved by means of multiple reflections on the side faces 110 of the substrate 115. In FIG. 10*b* the reflection points on the main surface of the substrate 115 are not shown for the sake of clarity, but only the direction of propagation of the ultrasound waves 104, which is caused by reflection on the main surfaces of the substrate 115, as described for example with reference to FIG. 8*a*.

Figure 11:
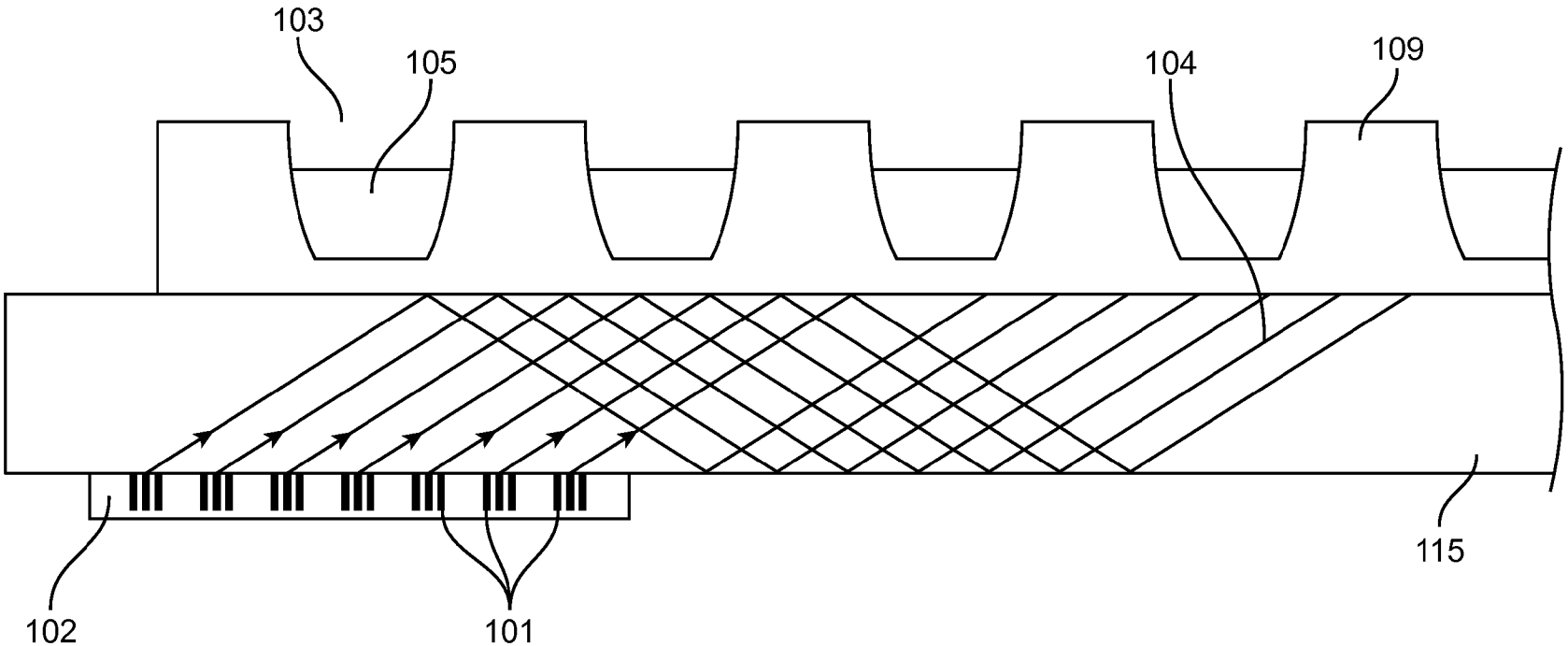
FIG. 11 illustrates a lateral cross-sectional view of a device for carrying out a method according to the present invention.

FIG. 11 illustrates a lateral section through another arrangement for carrying out a method according to the present invention. The beam cross-section is here effectively broadened, in that several interdigital transducers 101 are utilised for generating parallel bundles of beams 104. In this way the upper boundary surface of the substrate 115 can be exposed to ultrasonic waves in an almost homogeneous way, to expose for example several microcavities 105 of a microtitre plate 109 to ultrasonic waves at the same time.

Figure 12:
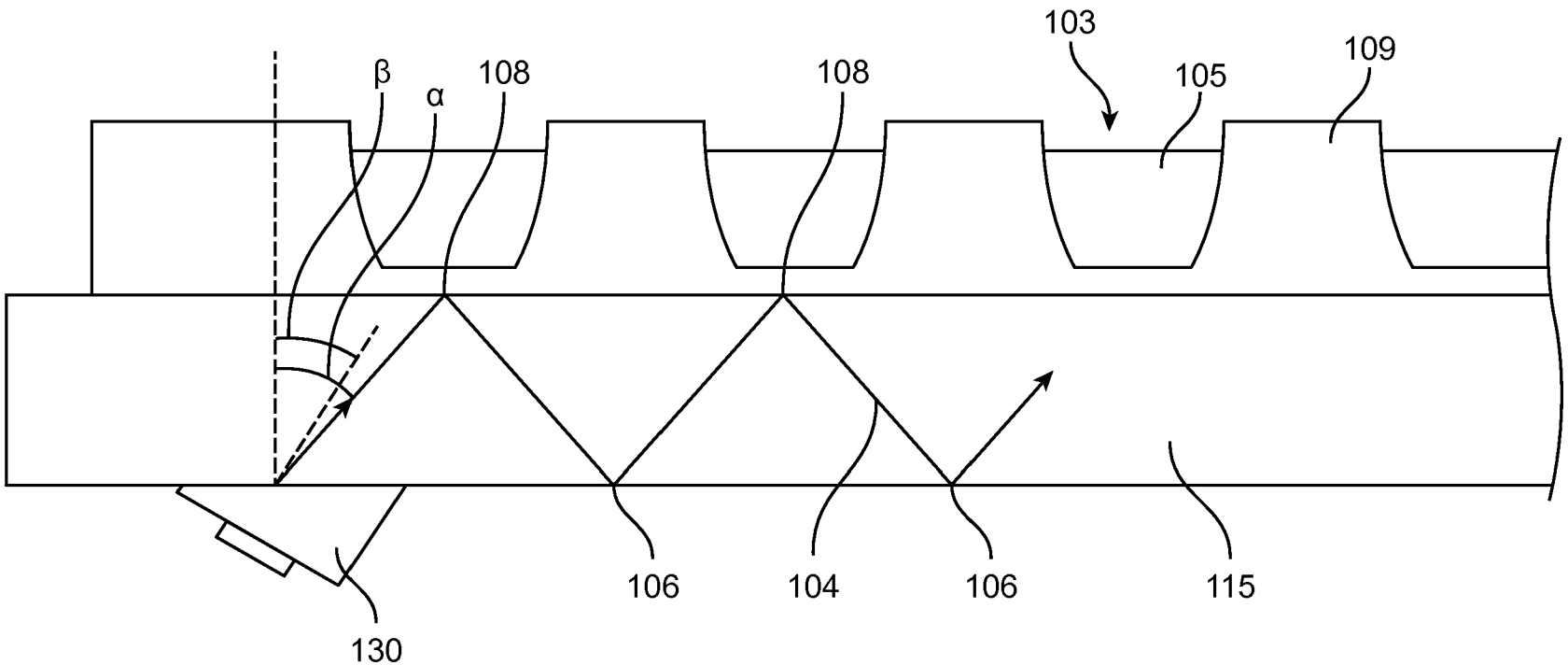
FIG. 12 illustrates a lateral cross-sectional view of a further device for carrying out a method according to the present invention.

The described reflection effect through selection of an appropriate substrate material for the substrate 115 can likewise be created by means of a volume oscillator 130, as is shown in FIG. 12. A piezoelectric thickness oscillator, arranged such that oblique inputting of the sound wave takes place, can be used as piezoelectric volume oscillator 130, for example. For this a so-called wedge transducer is used. The angle of incidence $\alpha$ to the surface normal of the surface, on which the wedge transducer was arranged, is determined from the angle $\beta$, at which it is arranged, and the ratio of the speed of sound of the wedge transducer $v_w$ and of the substrate 115 $v_s$ according to $\alpha=\arcsin[(v_s/v_w)\cdot\sin\beta]$.

Figure 13:
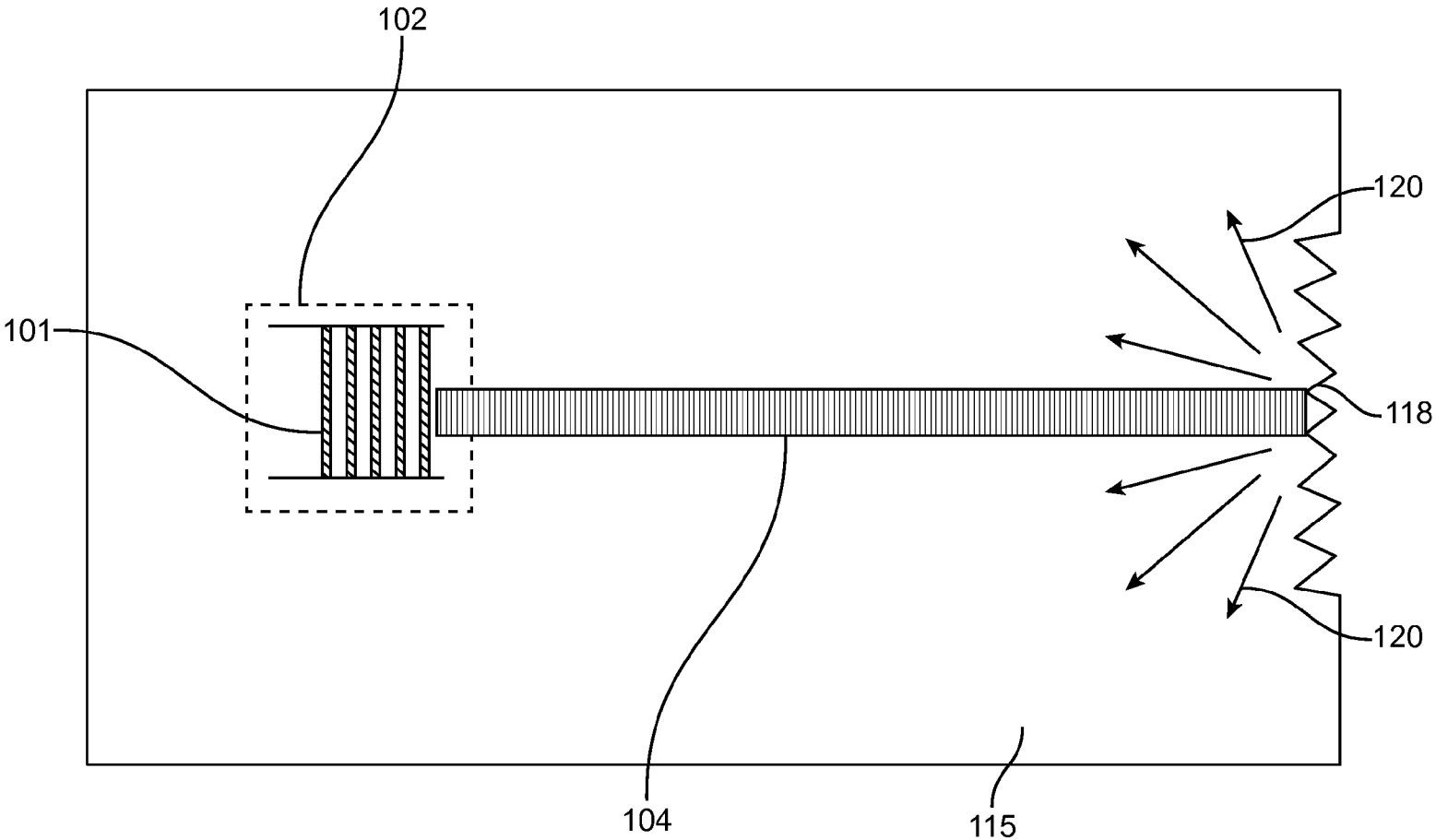
FIG. 13 illustrates a plan view of a cross-section of a further arrangement for carrying out a method according to the present invention.

FIG. 13 illustrates an embodiment, in which an edge 108 of the substrate 115 is roughened to bring about diffuse reflection of the incident sound wave 104. This can be useful to render ineffective an unwanted acoustic beam reflected at an edge. In such an embodiment explained similarly with reference to FIG. 8 the acoustic beam 104 is guided through the substrate 115 in the manner of a waveguides by reflections on the upper and lower main surface of the substrate 115. On the roughened surface 118 diffuse reflection takes place in the individual beams 120. In this way the directed acoustic beam 104 can be rendered ineffective, or respectively can be broadened such that homogeneous exposure to ultrasonic waves of several microcavities is possible, which are located on the substrate 115. FIG. 13 illustrates again a plan view of a cross-section approximately according to the upper boundary surface of the substrate 115.

Figure 14:
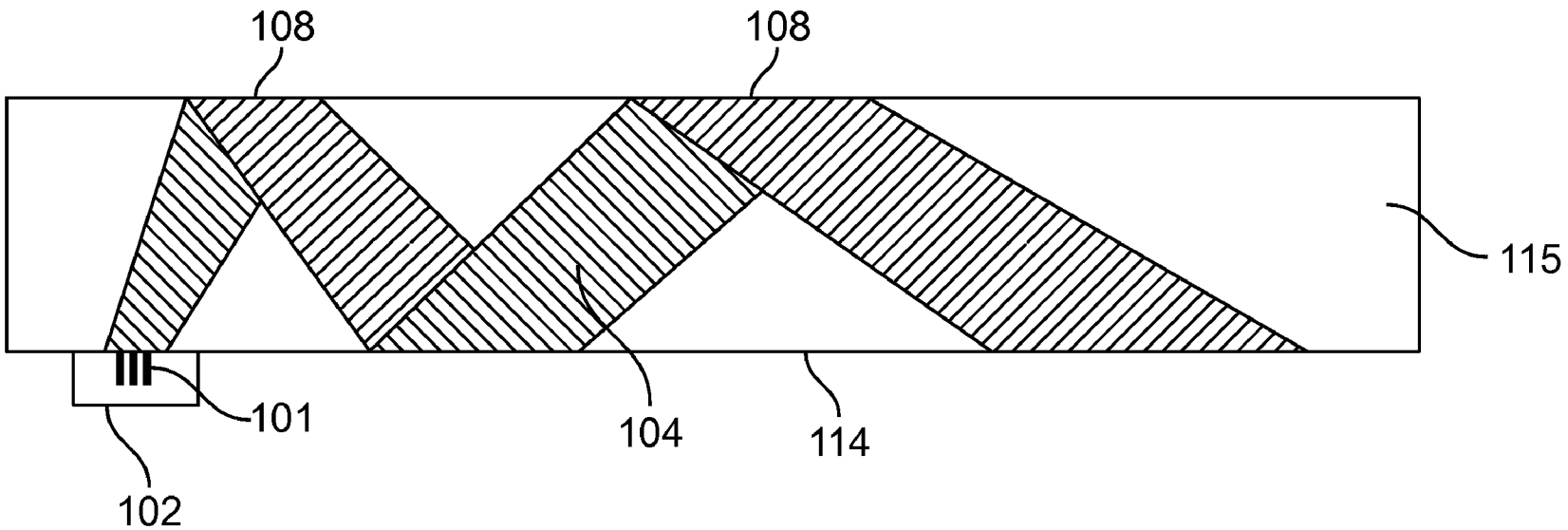
FIG. 14 illustrates a lateral partial view through an arrangement for carrying out a further configuration of the method according to the present invention.

FIG. 14 illustrates an embodiment, in which the rear surface 114 of the substrate 115 is roughened. Positioned on this rear surface is the interdigital transducer 101. With the described inputting of the ultrasound wave in the substrate 115 on account of the roughened surface the beam 104 is widened through diffraction. This effect is reinforced further still by the further reflections on the surface 114. With increasing distance of the input points 108 from the substrate in the not shown input medium, on which the microtitre plate is positioned, the input point is accordingly broadened. FIG. 14 here illustrates a partial cross-sectional view, in which the microtitre plate was not shown.

Figure 15:
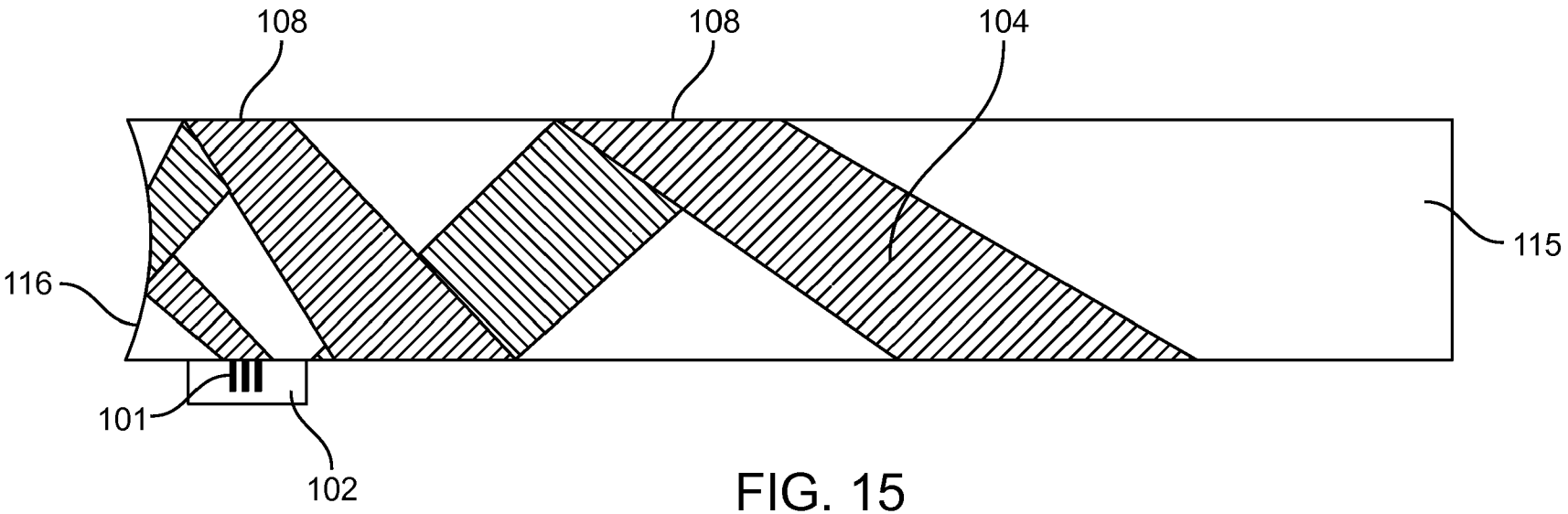
FIG. 15 illustrates a lateral partial view through an arrangement for carrying out a further configuration of the method according to the present invention.

A similar effect can be achieved with a configuration of FIG. 15. Here the widening of the sound beam 104 is achieved after input by the interdigital transducer 101 in the substrate 115 by reflection on a bulged reflection edge 116. Just as widening is described here, focussing by means of an accordingly designed reflection edge can be achieved. FIG. 15 also illustrates only a partial cross-sectional view, in which the substrate 115 is shown. Arranged on the substrate 115 are for example the input medium 111 and the microtitre plate 109, as described though not shown here.

Figure 16:
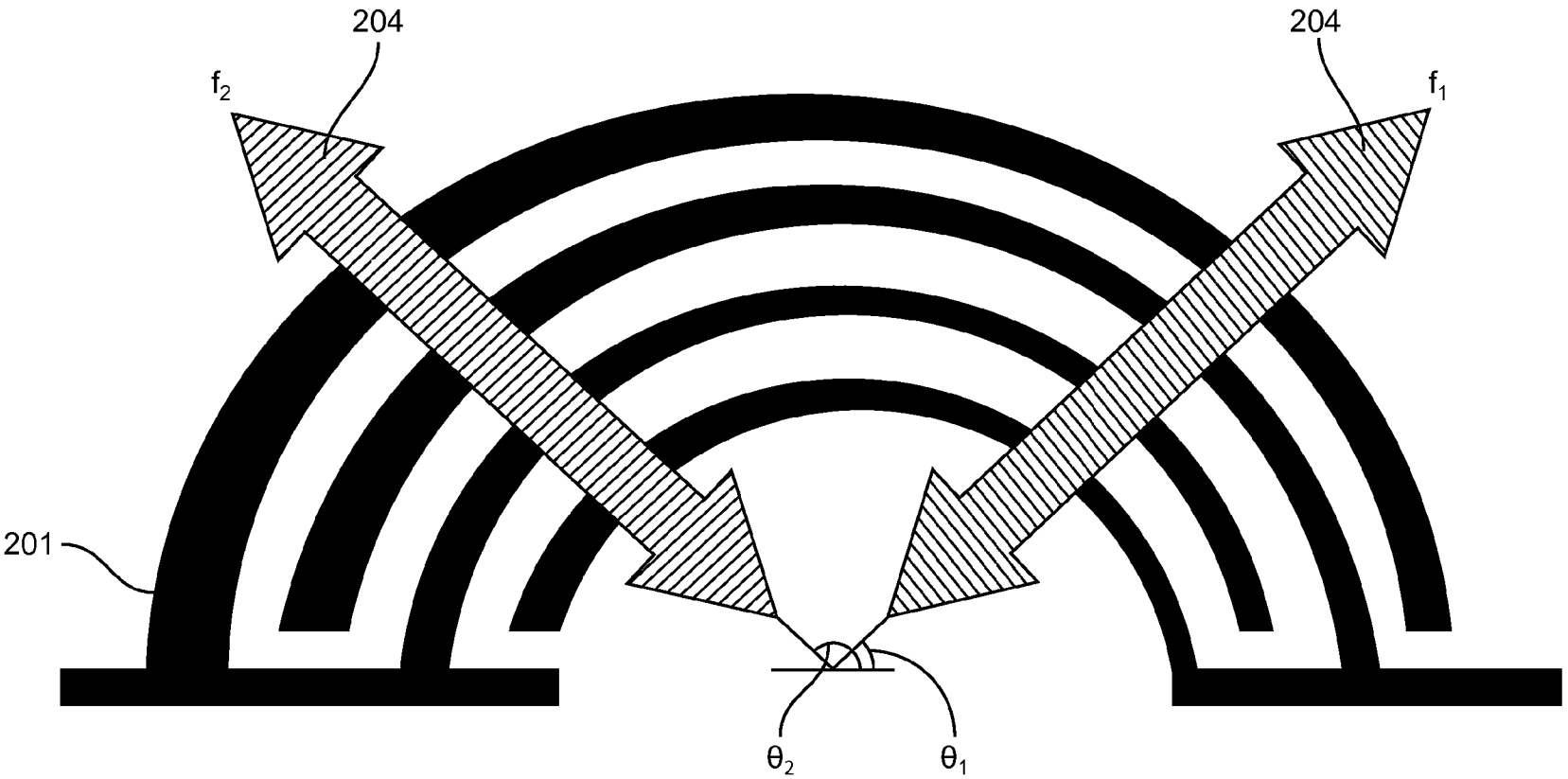
FIG. 16 illustrates a plan view of a cross-section of an arrangement for carrying out a further configuration of the method according to the present invention.

FIG. 16 illustrates a further configuration in schematic illustration. Here too the view of the boundary surface between substrate 115 and input medium 111 is shown. As in the other illustrations also, for the sake of clarity only a few fingers of the interdigital transducer 201 engaging in one another are shown here, even though a complete interdigital transducer has a larger number of finger electrodes. The distance of individual finger electrodes of the interdigital transducer 201 is not constant. In the case of a supplied high frequency the interdigital transducer 201 thus radiates only at one place, in which the finger distance correlates accordingly with the frequency, as is described for another application for example in WO 01/20781 A1.

In the configuration of FIG. 16 the finger electrodes are also not straight, but curved. Since the interdigital transducer radiates substantially perpendicular to the alignment of the fingers, the direction of the radiated surface sound wave can be determined in this way via selection of the supplied high frequency. In FIG. 16 the direction of radiation 204 for two frequencies f1 and f2 are shown by way of example, whereby with the frequency f1 the direction of radiation is given by the angle $\theta$1 and for the frequency f2 by the angle $\theta$2. FIG. 16 schematically illustrates the plan view of the boundary surface between the piezoelectric substrate 102, on which the interdigital transducer 201 is arranged, and the substrate 115, which is in contact with the piezoelectric substrate 102.

Figure 17A:
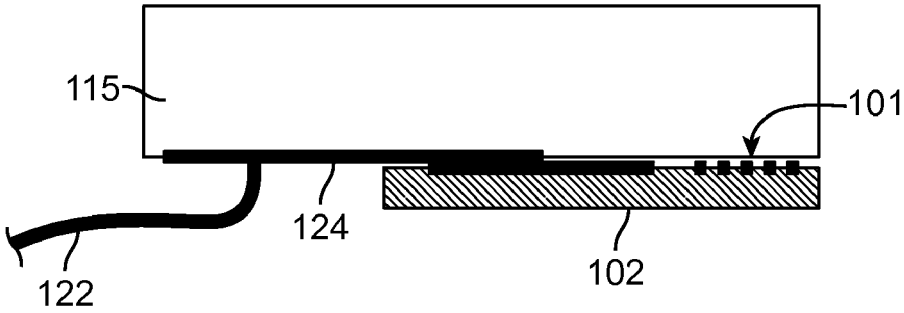
FIG. 17*a-c* illustrates schematic partial views of various configurations of the electrical contacting of a device for carrying out a method according to the present invention.
Figure 17B:
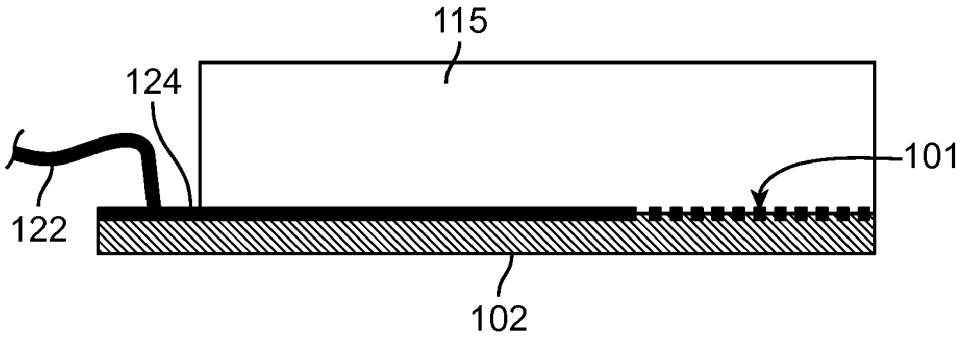
Figure 17C:
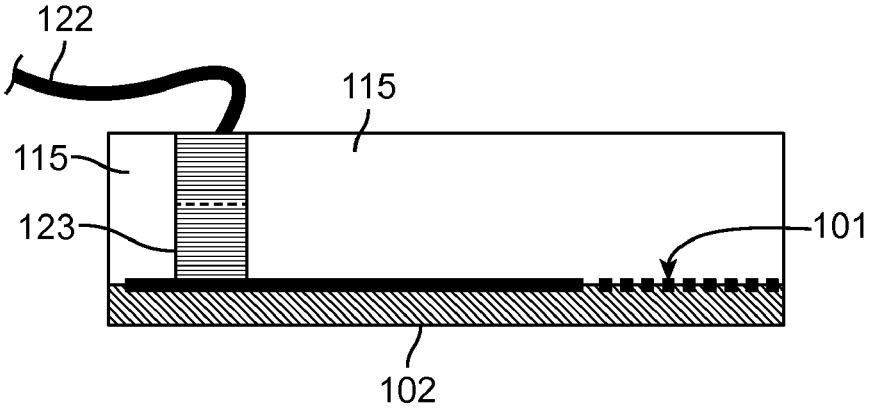

FIGS. 17*a* to 17*c* show different possibilities for electrical contacting of interdigital transducer electrodes in the embodiments of FIGS. 8, 9, 10, 11, 13, 14, 15 or 16. In the embodiment, as illustrated in FIG. 17*a*, metallic strip conductors are arranged on the substrate 115 on the rear side. The piezoelectric crystal 102 with the interdigital transducer 101 is placed on the substrate 115 such that an overlap of the metallic electrode results on the substrate 115 with an electrode of the interdigital transducer 101 on the piezoelectric substrate 102. When the piezoelectric ultrasonic transducer is stuck to the substrate, in the overlap region an electrically conductive adhesive is used, whereas the remaining surface is stuck with conventional non-electrically conductive adhesive. If needed, purely mechanical contact does suffice. The electrical contacting 122 of the metallic strip conductors on the substrate 115 in the direction of the not shown high frequency generator electronics is effected through soldering, adhesive binding or a spring-loaded contact pin.

In the embodiment of the electrical contacting of FIG. 17*b* the piezoelectric crystal 102, on which the interdigital transducer electrodes with supply lines 124 are arranged, are attached to the substrate 115 such that a projection from the first to the second results. In this case the contacting 122 sits directly on the electrical supply lines 124 arranged on the piezoelectric crystal 102. The contact can be soldered, stuck or bonded, or can take place by means of a spring-loaded contact pin.

In the embodiment of electrical contacting, as in FIG. 17*c*, the substrate 115 is provided with one hole 123 per electrical contact and the piezoelectric crystal 102 is placed directly on the substrate 115 such that the electrical supply lines attached to the piezoelectric ultrasonic transducer can be contacted through the holes 123. The electrical contact can be made in this case by a spring-loaded contact pin directly on the electrical supply lines on the piezoelectric crystal 102. A further possibility is to fill the hole with a conductive adhesive 123 or thus to stick in a metallic bolt. Further contacting 122 in the direction of high-frequency generator electronics then occurs by soldering, further adhesive joining or a spring-loaded contact pin.

A further possibility for supplying the electrical power to the piezoelectric ultrasonic transducer is inductive coupling. At the same time the electrical supply lines to the interdigital transducer electrodes are designed such that they serve as an antenna for contact-free control of the high frequency signal. In the simplest case this is an annular electrode on the piezoelectric substrate, which acts as secondary circuit of a high-frequency transformer, whereof the primary circuit is connected to the high frequency generator electronics. This is held-externally and is attached directly adjacent to the piezoelectric ultrasonic transducer.

Individual configurations of the method or respectively of the features of the described embodiments can also be combined in appropriate form, to achieve the resulting effects at the same time.

With the method according to the present invention efficient thorough mixing of the smallest quantities of liquid is possible. It is not necessary for the liquid to come into contact with the motion-compromising medium itself. There must be for example no mixing element introduced to the liquid. The method or respectively the device can be applied easily and cost-effectively with contemporary laboratory automated instruments, as used in biology, diagnostics, pharmaceutical research or chemistry. The use of high frequencies effectively avoids the development of cavitation. And finally a flat construction can be realised and the device can easily be used in laboratories.

The invention claimed is:

1. A method for thoroughly mixing liquids in a microcavity, comprising the steps of providing said microcavity on one side of a solid-body layer, arranging an interdigital transducer on a piezoelectric crystal, providing said piezoelectric crystal below said solid body layer opposite the side on which said microcavity is provided, generating an ultrasound wave of a frequency greater than or equal to 10 MHz from said interdigital transducer, such that said ultrasound wave is generated as a surface wave at the surface of said piezoelectric crystal and is then transformed into a bulk acoustic wave within said solid-body layer, and wherein said bulk acoustic wave travels through said solid-body layer to the opposite side of said solid-body layer on which said microcavity is provided, and providing said solid-body layer to have a dimension, in the direction of sound propagation, which is greater than ¼ of the wavelength of the ultrasound wave, for generating a sound-induced flow in said microcavity.

2. The method as claimed in claim 1, wherein the wavelength of the ultrasound wave in a liquid in said microcavity is selected such that it is less than the average filling level (F) in said microcavity.

3. The method as claimed in claim 1, wherein the lateral expansion (d) of said transducer is less than the lateral dimension (D) of the microcavity.

4. The method as claimed in claim 1, wherein an intermediate layer is introduced in between said transducer and the microcavity, the intermediate layer including an ultrasound-absorbing material in an arrangement, such that the ultrasound wave is only in a limited spatial area.

5. The method as claimed in claim 1, wherein an equilibrium medium is introduced in between the microcavity and the solid-body layer.

6. The method as claimed in claim 1, wherein several microcavities are used.

7. The method as claimed in claim 6, wherein the microcavities of a microtitre plate are used.

8. The method as claimed in claim 7, wherein the transducer is used, in which the lateral dimension (d) is less than the diameter (D) of a cavity of the microtitre plate, and the microtitre plate is arranged for individual thorough mixing of liquid in a selected cavity with this selected cavity above the transducer on the solid-body layer.

9. The method as claimed in claim 7, wherein a microtitre plate with several transducers, which are in the modular dimension (R) of the plate and are arranged on the solid-body material, is used.

10. The method as claimed in claim 6, wherein several transducers are used which are controlled individually.

11. The method as claimed in claim 6, wherein by the transducer, said ultrasound wave is sent through the solid-body layer such that ultrasound output is input at least at two output points from the solid-body layer into a corresponding number of microcavities.

12. The method as claimed in claim 11, wherein said ultrasound wave is sent obliquely through the solid-body layer.

13. The method as claimed in claim 11, wherein an ultrasound wave is input into the solid-body layer such that it is reflected at least once inside the solid-body layer, whereby a material is selected for the solid-body layer, wherein the reflection on the surface facing away from said microcavity is the greatest possible and on the surface facing the microcavity or respectively the liquid is lossy, but is not equal to 0, and the acoustic damping inside the solid-body layer is the least possible.

14. The method as claimed in claim 11, wherein the at least two output points are generated by temporal variation in the direction of radiation of the at least one transducer.

15. The method as claimed in claim 1, wherein said ultrasound wave is generated by the interdigital transducer on the piezoelectric element, in which the interdigital transducer comprises finger electrodes that engage one another and have a distance from one another not spatially constant, and a radiation site is adjusted by changing the frequency applied to the interdigital transducer.

16. The method as claimed in claim 15, wherein the interdigital transducer is used, in which the finger electrodes engaging in one another are not straight, but in particular are curved, and the direction of radiation is chosen by selection of the frequency of the applied high frequency field.

17. The method as claimed in claim 1 wherein said ultrasound wave is generated by the interdigital transducer on the piezoelectric element on a side of the solid-body layer facing away from said microcavity.

18. The method as claimed in claim 1, wherein a solid-body layer is used, which has at least one diffusively scattering surface, to spread out said ultrasound wave in the solid-body layer.

19. The method as claimed in claim 1, wherein the direction of propagation of said ultrasound wave is deflected in the solid-body layer by reflection surfaces.

20. A method in accordance with claim 1, wherein the piezoelectric crystal is adhered, pressed or bonded to the solid-body layer or adhered, pressed or bonded to the solid-body layer via a coupling medium.

21. A method in accordance with claim 1, wherein cavitation in mixing is avoided or eliminated.

22. A method in accordance with claim 1, comprising the additional step of fixing a position of said transducer and said microcavity with respect to one another.

23. A device for thoroughly mixing liquids comprising:

a microcavity, a solid-body layer having said microcavity arranged on an upper side thereof, an interdigital transducer, a piezoelectric element on which said interdigital transducer is provided, and a film positioned between at least one of (i) said microcavity and solid-body layer, and (ii) said piezoelectric element and solid body layer, wherein said piezoelectric element is arranged below the solid-body layer opposite the side of said solid-body layer on which said at least one microcavity is arranged and spaced below a lowest point of said microcavity, wherein said interdigital transducer is configured to generate an ultrasound wave of a frequency greater than or equal to 10 MHz, with the dimension of the solid-body layer greater than ¼ of the ultrasound wavelength in the direction of sound propagation through said solid-body layer from one side to the other; and wherein said interdigital transducer, piezoelectric element, and solid-body layer are arranged such that said ultrasound wave is generated as a surface wave at the surface of said piezoelectric element and is then transformed into a bulk acoustic wave within said solid-body layer.

24. The device as claimed in claim 23 with a plurality of transducers in the modular dimension (R) of a microtitre plate.

25. The device as claimed in claim 24 with a switching mechanism for controlling individual transducers in the plurality of transducers.

26. The device as claimed in claim 23, wherein the transducer is selected such that the ultrasound wave generated by it has a wavelength which is less than the height expansion of the microcavity.

27. The device as claimed in claim 23, wherein the lateral expansion (d) of the transducer is less than the lateral expansion (D) of a cavity of a microtitre plate.

28. The device as claimed in claim 23 wherein said film is positioned on a main surface of the solid-body layer, and has an ultrasound-absorbing medium in an arrangement which delimits the ultrasound radiation in the direction of the microcavity spatially and in an arrangement of microcavities of a microtitre plate.

29. The device as claimed in claim 23, wherein the transducer is configured such that at least one ultrasound wave is input obliquely into the solid-body layer.

30. The device as claimed in claim 29, wherein the transducer radiates bidirectionally.

31. The device as claimed in claim 29, wherein a material of the solid-body layer is selected such that the reflections on the surface facing away from the microcavity are the greatest possible and the reflections on the side facing the microcavity or respectively the liquid are lossy, but not equal to 0, and the acoustic damping inside the solid-body layer is the least possible.

32. The device as claimed in claim 23, wherein the interdigital transducer is contacted via a hole through the solid-body layer filled with a conductive adhesive.

33. The device as claimed in claim 23, wherein the interdigital transducer has antenna devices.

34. The device as claimed in claim 23, wherein the interdigital transducer comprises finger electrodes that do not have a spatially constant distance from one another.

35. The device as claimed in claim 34, wherein the finger electrodes of the interdigital transducer are designed not straight, but in particular are designed curved.

36. The device as claimed in claim 23, wherein the solid-body layer has at least one diffusively scattering surface.

37. The device as claimed in claim 23, wherein the film constitutes a coupling medium through which said piezoelectric crystal is adhered, pressed or bonded to the solid-body layer.

38. The device as claimed in claim 37, wherein an electrical connection of the interdigital transducer is formed by a first supply line on the piezoelectric element and a second supply line formed on the solid-body layer, arranged such that they overlap one another.

39. The device as claimed in claim 37, wherein the piezoelectric element has a projection over the solid-body layer, on which a contact point for the electric supply line to the interdigital transducer is located.

40. The device as claimed in claim 23, comprising two films, a first film positioned between said microcavity and solid-body layer, and a second film positioned between said piezoelectric element and solid body layer.

41. The device as claimed in claim 40, wherein said films are composed of water, oil, glycerine, silicon, epoxide resin or gel.

42. The device as claimed in claim 23, wherein a position of said transducer and said microcavity with respect to one another is fixed.

43. A device for thoroughly mixing liquids comprising:

a microcavity, a solid-body layer having said microcavity arranged on an upper side thereof, an interdigital transducer, and a piezoelectric element on which said interdigital transducer is provided, wherein said piezoelectric element is in direct solid contact with the solid-body layer and below the solid-body layer opposite the side of said solid-body layer on which said microcavity is arranged and spaced below a lowest point of said microcavity, wherein said interdigital transducer is configured to generate an ultrasound wave of a frequency greater than or equal to 10 MHz, with the dimension of the solid-body layer greater than ¼ of the ultrasound wavelength in the direction of sound propagation through said solid-body layer from one side to the other; and wherein said interdigital transducer, piezoelectric element, and solid-body layer are arranged such that said ultrasound wave is generated as a surface wave at the surface of said piezoelectric element and is then transformed into a bulk acoustic wave within said solid-body layer.

44. The method of claim 43, wherein ultrasound can spread out in the direction of the microcavity only in an area smaller than a lateral dimension (D) of the microcavity.

45. The device as claimed in claim 43, wherein a position of said transducer and said microcavity with respect to one another is fixed.

* * * * *

UNITED STATES PATENT AND TRADEMARK OFFICE

CERTIFICATE OF CORRECTION

PATENT NO. : 8,038,337 B2
APPLICATION NO. : 10/547267
DATED : October 18, 2011
INVENTOR(S) : Andreas Rathgeber et al.

It is certified that error appears in the above-identified patent and that said Letters Patent is hereby corrected as shown below:

On the Title Page

In the Abstract Item (57), please insert the abstract as follows:

-- The invention relates to a method for thoroughly mixing liquids in at least one microcavity using sound-induced flow, in which by means of at least one piezoelectric ultrasonic transducer at least one ultrasound wave of a frequency greater than or equal to 10 MHz is sent through a solid-body layer extending in the direction of sound propagation, which is greater than ¼ of the wavelength of the ultrasound wave, for generating a sound-induced flow into the at least one microcavity, and a device for carrying out the method according to the present invention. --

Signed and Sealed this
Tenth Day of January, 2012

David J. Kappos

David J. Kappos
*Director of the United States Patent and Trademark Office*